US005854540A

United States Patent [19]

Matsumoto et al.

[11] Patent Number: 5,854,540

[45] Date of Patent: Dec. 29, 1998

[54] PLASMA DISPLAY PANEL DRIVING METHOD AND PLASMA DISPLAY PANEL DEVICE THEREFOR

[75] Inventors: Sadayuki Matsumoto; Takashi Hashimoto; Takahiro Urakabe; Shigeki Harada; Masao Karino, all of Tokyo, Japan

[73] Assignee: Mitsubishi Denki Kabushiki Kaisha, Tokyo, Japan

[21] Appl. No.: 782,917

[22] Filed: Jan. 13, 1997

[30] Foreign Application Priority Data

Jun. 18, 1996 [JP] Japan ..... 8-157013

[51] Int. Cl.[6] ..... G09G 3/10

[52] U.S. Cl. ..... 315/169.1; 315/169.4; 345/204; 345/215

[58] Field of Search ..... 315/169.1–169.4, 315/84.51; 313/584–586; 345/37, 55, 67, 204, 211, 214, 215, 60

[56] References Cited

U.S. PATENT DOCUMENTS

| | | | |
|---|---|---|---|
| 5,237,315 | 8/1993 | Gay et al. | 315/169.4 X |
| 5,247,288 | 9/1993 | Warren et al. | 345/60 |
| 5,250,936 | 10/1993 | Warren et al. | 345/60 |
| 5,410,219 | 4/1995 | Takei et al. | 315/169.4 |
| 5,420,602 | 5/1995 | Kanazawa | 345/67 |

FOREIGN PATENT DOCUMENTS

| | | |
|---|---|---|
| 5313598 | 11/1993 | Japan . |
| 7049663 | 2/1995 | Japan . |
| 7140922 | 6/1995 | Japan . |
| 7160218 | 6/1995 | Japan . |
| 7287548 | 10/1995 | Japan . |
| 8221036 | 8/1996 | Japan . |
| 8278766 | 10/1996 | Japan . |

*Primary Examiner*—Benny Lee
*Assistant Examiner*—Haissa Philogene
*Attorney, Agent, or Firm*—Sughrue, Mion, Zinn, Macpeak & Seas, PLLC

[57] ABSTRACT

A method of driving a plasma display panel for generating picture or image with high quality while suppressing luminance to a low level in the display in black. One field for image display is composed of at least two different types of subfields first and second subfields. In the first subfield (subfield A), a reset period is provided in which after a priming pulse (Pp) having a voltage value and a pulse width has been applied between X- and Y-row electrodes for causing discharge to occur in all of pixels, then the voltage applied between both the electrodes is set to zero for erasing wall charge after the discharge of all of the pixels, while in the second subfield (subfield B), a reset period is provided in which an erasing pulse (Ep) having a voltage value and a pulse width for causing only the pixels discharged in the preceding subfield to be discharged has been applied for allowing only the pixels discharged in the preceding subfield to be discharged, the wall charge is erased by setting to zero the voltage applied between the X- and Y-row electrodes.

20 Claims, 16 Drawing Sheets

PLASMA DISPLAY PANEL DRIVING METHOD AND PLASMA DISPLAY PANEL DEVICE THEREFOR

BACKGROUND OF THE INVENTION

1. Field of the Invention

The present invention relates generally to a method for driving an AC type plasma display panel device. More particularly, the invention is concerned with a driving method for a plane discharge type plasma display panel device and a structure of such display panel device which is suited for carrying out the driving method.

2. Description of Related Art

Before entering into description of the invention, the technical background thereof will be reviewed in some detail for having a better understanding of the invention. FIG. 18 shows partially in a perspective view a structure of a plane discharge type AC plasma display panel device which is one of the conventional AC plasma display devices known heretofore and disclosed, for example, in Japanese Unexamined Patent Application Publications Nos. 140922/1995 and 287548/1995 (JP-A-7-140922 and JP-A-7-287548). Referring to the figure, a plane discharge type plasma display panel device denoted generally by reference numeral 100 includes a front panel glass substrate 102 constituting a display screen panel and a rear panel glass substrate 103, wherein the substrates 102 and 103 are disposed in opposition to each other with a discharge space being interposed or defined therebetween, wherein pairs of first row electrodes 104 (X1 to Xn) and second row electrodes 105 (Y1 to Yn), respectively, are fixedly mounted on the front panel glass substrate 102. Formed over these row electrodes 104 and 105 is a dielectric layer 106 which is covered with an MgO (magnesium oxide)-layer 107 deposited over the top surface of the dielectric layer 106. On the other hand, disposed fixedly on the rear panel glass substrate 103 in opposition to the row electrodes 104 and 105 are column electrodes 108 (W1 to Wm) which extend in the direction orthogonal to the row electrodes 104; 105. Further, phosphor layers 109 adapted to emit lights in red, green and blue, respectively, are formed in stripe-like geometry orderly on each of the column electrodes 108. In this case, the discharge cell defined at the intersection between the pair of the row electrodes 104 and 105 and the column electrode 108 extending orthogonally thereto defines a picture element or pixel. For separating the discharge cells from one another and defining the discharge spaces, partition walls 110 are provided.

Next, description will turn to operation of the plasma display panel of the structure mentioned above. A voltage pulse signal is applied alternately between the first row electrodes 104 and the second row electrodes 105 to bring about electric discharge with polarity being inverted for every half period to thereby cause the cells to emit light. In the case of a color display, the phosphor layer 109 formed in each of the cells is excited by ultraviolet ray originating in the discharge. Because the first row electrodes 104 and the second row electrodes 105 which are intrinsically destined for the display function are each covered with the dielectric layer 106 as mentioned above, electrons and ions given birth to within the discharge space or chamber defined between the electrodes in each cell migrate in the direction determined by polarity of the voltage applied between the electrodes to be thereby stored in the dielectric layer 106. The electrons and ions stored in the dielectric layer 106 are referred to collectively as the wall charge. In this conjunction, it is to be noted that the electric field formed by the wall charge exhibits a tendency of enfeebling the strength of the applied electric field. Consequently, as the wall charge is formed, the discharge tends to become extinct speedily. After extinction of the discharge, the electric field is newly applied with the polarity inverted relative to that for the preceding discharge. In that case, the electric field formed by the wall discharge is superposed with the applied electric field. Thus, the discharge can take place at a lower level of applied voltage when compared with the preceding discharge. Subsequently, the discharge can be sustained by inverting the polarity of the low voltage as applied for every half period. Such phenomenon or function is referred to as the memory function. Further, the electric discharge which can be maintained or sustained with the low application voltage by taking advantage of the memory function mentioned above is referred to as the sustained discharge, while the voltage pulse applied to the first row electrode and the second row electrode at an interval corresponding to the half period is referred to as the discharge sustaining pulse. The sustained discharge can be maintained until the wall charge becomes extinct, i.e., so long as the sustaining pulse signal is applied. Extinction of the wall discharge is referred as the erasure or extinction, while operation for forming initially the wall charge on the dielectric layer is referred to as the write operation or simply as writing.

Next, a gradation display method applied to the AC type plasma display device will be reviewed briefly. FIG. 19 is a view showing a structure or composition of one field adopted in the conventional gradation display as disclosed, for example, in Japanese Unexamined Patent Application Publication No. 160218/1995 (JP-A-7-160218). At this juncture, with the term "one" it is intended to mean a time or temporal period for outputting one frame of picture on a display screen According to the NTSC (National Television System Committee) standards, one field has a duration of about 16.7 msec (60 Hz). Referring to the figure, display lines represent lines extending rowwise and containing first and second row electrodes. Further, in FIG. 19, time lapse is taken along the abscissa. Besides, one field is divided into several subfields, wherein each of the subfield contains a reset period, an addressing period and a sustained discharge period, as can be seen in FIG. 19. Assuming, by way of example, that picture or image is displayed with 256 gradations (i.e., $2^8$ gradations), the number of the subfields contained in one field amounts to eight, wherein the sustained discharge period in each of the subfields is so set as to assume a ratio of $2^n$ (where n=0, . . . , 7).

FIG. 20 is a view showing waveforms of voltages applied to the row electrodes within one subfield in the conventional plasma display panel driving method disclosed, for example, in Japanese Unexamined Patent Application Publication No. 160218/1995 (JP-A-7-160218). In the case of this conventional display panel, the first row electrodes X are connected in common and a same driving voltage are applied to all the first row electrodes X. On the other hand, the second row electrodes Y and the column electrodes W can be applied with respective driving voltages individually on a line-by-line basis. In FIG. 20, there are illustrated voltage waveforms applied to the column electrode Wj, the first row electrode X and the second row electrodes Y1, Y2 and Yn, respectively, in this order as viewed from the top.

During the reset period, all the cells of the AC type plasma display panel device are set to a same state. More specifically, referring to FIG. 20, a whole panel write pulse Pp (also referred as the priming pulse) is applied to the first row electrodes X connected in common at a starting time point a. Since the whole panel write pulse or priming pulse Pp is set at a voltage level higher than the voltage for triggering the discharge between the first row electrodes X and the second row electrodes Y, the electric discharge and hence light emission take place in all the cells regardless of the cell operation in the preceding subfield. At this time point, a voltage pulse is applied to the column electrodes W as well. This voltage pulse is however for the purpose of lowering the potential difference between the electrodes X and W so that no discharge can occur between the first row electrodes X and the column electrodes W. Accordingly, the voltage value of this pulse is set at about a half of the voltage applied across the electrodes X and Y. Upon application of the whole panel write pulse Pp, electric discharge of higher intensity takes place between the electrodes X and Y, as a result of which a large quantity of wall charges is stored between the electrodes X and Y before the discharge ends Subsequently, the pulse Pp falls at a time point b shown in FIG. 20, whereby the voltage applied to the first row electrodes X and the second row electrodes Y makes disappearance. In this state, electric field formed by the wall charge stored under the effect of the whole panel write pulse Pp continues to remain between the electrodes X and Y. The strength of this electric field is sufficiently large to bring about spontaneously electric discharge. Thus, discharge takes place again between the electrodes X and Y. However, because no voltage is applied externally, the electrons and ions given birth to by this discharge are neutralized without being attracted toward the row electrodes X and Y. In this manner, by performing the write operation and then the erasing operation for all the cells, it is possible to realize the cell state in which the wall charges are "cleared" from all the cells of the display panel regardless of "presence" or "absence" of the wall charge in the preceding subfield. In other words, the so-called reset operation is realized for the display panel. The discharge by which the wall charge is cleared under the effect of the wall charge itself even in the state where no external voltage is applied is referred to as the self-extinction discharge.

At a time point c succeeding to the end of the reset period (see FIG. 20), substantially no wall charge remains either at the first row electrode or the second row electrode. On the other hand, a very small amount of charged particles given birth to by the discharge triggered by the preceding whole panel write pulse Pp still remains within each of the cells. These charged particles serve for triggering the discharge in the succeeding write cycle. In other words, these charged particles play a role as a primer, so to say. Thus, it can be said that the single whole panel write pulse serves not only for the erasing function but also for the priming function.

Referring again to FIG. 20, during the addressing period, "presence" and "absence" of the wall charge in the individual cells are controlled by selecting given cells of the screen panel through selection of the row electrodes and the column electrodes arrayed in a matrix form. The write operation mentioned hereinbefore is effectuated during this addressing period. Further, in this addressing period, a scanning pulse signal Scp of minus or negative polarity is applied sequentially to the second row electrodes Y1 to Yn which are independent of each other. On the other hand, applied to the column electrodes W are the addressing pulses Ap in accordance with the contents of the picture data. Through cooperation of the scanning pulse Scp applied to the second row electrodes Y and the addressing pulse Ap applied to the column electrodes W, given cells arrayed in a matrix form on the screen panel can be selectively excited. In this conjunction, it is noted that the total sum of the voltage values of the scanning pulse Scp and the addressing pulse Ap is set at a higher level than the voltage level for triggering the discharge between the electrodes Y and W. Accordingly, in the cells which are applied with both the scanning pulse Scp and the addressing pulse Ap at the same time, electric discharge can take place. On the other hand, the first row electrodes X connected in common are maintained at a positive voltage level during the addressing period. This voltage value is so low that no discharge can occur between the electrodes X and Y even when the scanning pulse Scp is applied simultaneously. However, the voltage value of the positive polarity is so selected that electric discharge taking place between the electrodes X and W is effective for triggering concurrent occurrence of discharge between the electrodes X and Y as well. Parenthetically, the discharge occurring between the electrodes X and Y, being triggered by the discharge between the electrodes Y and W, may be referred to as the write sustaining discharge. Due to this write sustaining discharge, the wall charge can be stored in the first row electrodes and the second row electrodes.

After completion of the scanning operation for all the cells of the display screen, the sustained discharge period is validated. During this sustained discharge period, discharge is sustained only in those cells in which the wall charge remains after the addressing period. Light emission based on this sustained discharge is made use of for the display. Thus, the cell having a longer duration of light emission due to the sustained discharge within one field has higher luminance. By controlling the light emission time for the individual cells in this manner, the display can be generated with gradation. More specifically, the sustaining pulse Sp is applied simultaneously for all the cells over the whole screen panel, whereby the sustained discharge is allowed to take place only for the cells in which the wall charge has been stored by the addressing operation during the addressing period. Subsequently, in the succeeding subfield, the whole panel write pulse Pp is applied to all the cells during the reset period, whereby the reset operation is performed. In this manner, all the cells are discharged in precedence to the subfield with the wall charge being stored in all the cells, whereon the reset operation can be validated for clearing the wall charge from all the cells due to the self-extinction discharge. Thus, the addressing operation can be performed constantly in the same cell state, to an advantage. However, the cells are forced to emit light in every subfield. Consequently, in the case of display with gradation of 256 levels, at least sixteen light emission occurs within one field because the discharge takes place not only at the rising edge but also at the leading edge of the whole panel write pulse, which means that luminance in the area displayed in black increases, lowering the contrast of picture or image as generated, to a disadvantage.

The driving method of separating the addressing period and the sustained discharge period for the whole screen panel of the AC type plasma display panel device as described above is referred to as the "addressing/display-separated driving method".

Because the priming effect due to the whole panel write operation can continue for a relatively long duration, it is not always necessary to execute the whole panel write operation in every field. As a method for suppressing increase of luminance in the area to be displayed in black due to the whole panel write operation, there is known a driving method in which the number of times the whole panel write operation is effected within one field is decreased, as disclosed in Japanese Unexamined Patent Application Publications Nos. 313598/1993 and 49663/1995 (JP-A-5-313598 and JP-A-7-49663). These known driving methods are illustrated in FIGS. 21 and 22. In the conventional driving methods, the whole panel write operation is performed only once within one field. It is however mentioned in the above publications that the whole panel write operation may be executed several times for one field, e.g. four times of whole panel write operations within one field which is composed of eight subfields.

FIG. 22 is a view for illustrating waveforms of voltage applied to various electrodes in the subfield (first subfield) in which the whole panel write operation is effectuated and corresponding voltage waveforms in the subfield (second subfield) in which the whole panel write operation is not executed. As can be seen in the figure, one and the same erasing pulse Ep is employed for erasing all the cells over the whole screen panel equally in the subfield in which the whole panel write operation is performed as well as in the subfield where no whole panel write operation is performed. In succession to application of the whole panel write pulse Pp, the sustaining pulse Sp is applied once for realizing the sustained discharge. More specifically, since the discharge for whole panel write operation and the sustained discharge mutually differ in respect to the strength or intensity, it is required to apply once the sustaining pulse Sp for the purpose of equalizing the wall charge stored by the discharge in order that for both the subfield in which the whole panel write operation has been performed and the subfield in which the whole panel write operation has not executed, erasure can be realized with one and the same erasing pulse Ep. Although it is mentioned in the above cited publication that either a narrow width erasing pulse (having a voltage level substantially equal to the sustaining pulse and a pulse width on the order of 0.5 $\mu$sec) and the broad width pulse (having a pulse width substantially equal to that of the sustaining pulse and a voltage level lower than the latter) may be employed. However, in most of practical applications, both the narrow width pulse and the broad width pulse are employed.

In the case of the first mentioned conventional driving method, the self-extinction is made use of for the erasure in the reset period, whereby the resetting operation can be realized with high reliability while assuring a relatively wide margin for the erasure, to an advantage. However, this driving method suffers a problem that luminance of area to be displayed in black increases due to the light emission effected in all the subfields.

On the other hand, in the case of the second mentioned driving method for the plasma display panel device is disadvantageous in that the margin secured for the erasure is practically limited due to the use of the narrow width erasing pulse and the broad width erasing pulse. Additionally, in the subfield in which the whole panel write operation is performed, the sustained discharge has to be performed several times in order to equalize the conditions for the erasure. Thus, it is impossible to suppress sufficiently the luminance in the area to be displayed in black. In this conjunction, it is certainly conceivable to adopt the self-extinction erasure for the subfield in which the whole panel write operation is to be performed, while for the other subfield, combination of the broad width erasing pulse and the narrow width erasing pulse is employed. In that case, however, the state of the plasma display panel device undergone the resetting operation (erasing operation) may differ from one to another subfield because of different erasing processes and hence nonuniform degree of extinction of the wall charge, as a result of which the voltage for the write operation may change in dependence on the subfields with the margin for the addressing operation undergoing variation, giving rise to another problem.

SUMMARY OF THE INVENTION

In the light of the state of the art described above, it is an object of the present invention to provide a plasma display panel device and a method of driving the same which can avoid the problems mentioned above and in which role of the priming pulse (whole panel write pulse) is divided discretely to a function for making available a minute amount of charged particles which play a primary role in realizing the priming effect and a function for resetting the plasma display panel device by erasing the wall charge, for thereby lowering luminance of light emission in an area to be displayed in black.

Another object of the present invention is to provide a plasma display panel device and a driving method therefor in which the number of the subfields for the whole panel write operation with the priming pulse is deceased for thereby suppressing luminance in an area of a picture to be displayed in black, while making it possible to realize a same state of the plasma display panel device after resetting of the subfield in which the self-extinction erasure is performed by resorting to the priming pulse and the subfield in which the whole panel write operation is not performed by applying the erasing pulse.

Further, it is still another object of the present invention to provide a plasma display panel device and a driving method for the same in which the priming pulse is applied at every other or every several-th line of the plasma display panel device by taking advantage of the fact that charged particles given birth to by the discharge triggered by the priming pulse migrate to adjacent lines for thereby suppressing luminance of an area displayed in black to a half or several-th one when compared with the conventional driving method.

Yet another object of the present invention is to provide a plasma display panel device and a driving method therefor in which same state can be established for both the lines of the plasma display panel which are reset by the self-extinction erasure after application of the priming pulse and the lines which are reset by applying an erasing pulse while sparing application of the priming pulse, to thereby stabilize uniformly the erasing operation, the addressing operation and the discharge sustaining operation and make it possible to generate pictures or images with improved display quality.

In view of the above and other objects which will become apparent as the description proceeds, there is provided according to a general aspect of the present invention a method of driving a plasma display panel device which is comprised of a plurality of first electrodes and a plurality of second electrodes covered with a dielectric layer, and a plurality of third electrodes disposed so as to extend orthogonally to at least one of the first and second electrodes to thereby define individual cells, respectively, wherein each of fields for image display includes at least two types of subfields, i.e., first and second subfields, wherein the first subfield includes a first reset period in which a priming pulse having a voltage value and a pulse width for causing discharge to occur in all of the cells defined between the first electrodes and the second electrodes is applied and after the discharge of all of the cells, the voltage applied between the first and second electrodes is set to zero for erasing wall charge stored in the dielectric layer, an addressing period in which write operation is performed by bringing about electric discharge between the first or second electrodes and the third electrodes for thereby allowing the wall charge to be stored in the dielectric layer, and a sustained discharge period in which an AC voltage is applied between the first and second electrodes for thereby realizing a sustained discharge by making use of the wall charge stored in the dielectric layer. On the other hand, the second subfield includes a second reset period in which an erasing pulse having a voltage value and a pulse width for causing only the cells discharged in the preceding subfield to be discharged is applied for allowing only the cells discharged in the preceding subfield to be discharged and thereafter the wall charge stored in the dielectric layer is erased by setting to zero the voltage applied between the first and second electrodes, an addressing period in which a write operation is performed by causing discharge to take place between the first or second electrodes and the third electrodes to thereby store the wall charge in the dielectric layer, and a sustained discharge period in which an AC voltage is applied between the first and second electrodes for realizing a sustained discharge by making use of the wall charge stored in the dielectric layer.

With the driving method for the plasma display panel device described above, the number of the priming pulses can be deceased without need for changing the condition for the addressing discharge as well as the condition for the sustained discharge, whereby stable operation of the plasma display panel device can be realized while suppressing luminance in an area to be displayed in black with contrast of picture or image as displayed being enhanced.

In a preferred mode for carrying out the method mentioned above, the priming pulse to be applied in the first subfield and the erasing pulse to be applied in the second subfield may be applied simultaneously to all of the cells of the plasma display panel device.

Owing to the feature described above, the driving method can be simplified with the plasma display panel device being implemented at low cost because the reset operation can be performed simultaneously for all the cells over the whole screen panel.

In another preferred mode for carrying out the invention, the priming pulse applied in the first subfield should preferably be applied through line sequential scanning in a rowwise direction of the plasma display panel device.

With the driving method mentioned above, the whole panel write operation can be carried out even when the voltage value of the priming pulse is low. Thus, the quantity of light emitted in the discharge triggered by the priming pulse can be reduced with the contrast of picture or image as displayed being further enhanced.

According to another aspect of the present invention, there is provided a method of driving a plasma display panel device which is comprised of a plurality of first electrodes and a plurality of second electrodes covered with a dielectric layer, and a plurality of third electrodes disposed so as to extend orthogonally to at least one of the first and second electrodes to thereby define individual cells, respectively, wherein each of the fields for image display includes the first subfield which includes at least a first reset period in which a priming pulse having a voltage value and a pulse width for causing discharge to occur in all of the cells defined between the first electrodes and the second electrodes is applied and after the discharge of all of the cells, the wall charge stored in the dielectric layer is erased, an addressing period in which write operation is performed by causing electric discharge to occur between the first or second electrodes and the third electrodes for thereby storing the wall charge in the dielectric layer, and a sustained discharge period in which an AC voltage is applied between the first and second electrodes for thereby realizing a sustained discharge by making use of the wall charge stored in the dielectric layer, and wherein the first subfield is executed for every other line or every several-th line of the plasma display panel device.

Owing to the driving method described above, the number of the priming pulses can be decreased with luminance in the area to be displayed in black can be reduced by a half or several-th one to ensure high contrast.

In yet another preferred mode for carrying out the invention, it is proposed that during the first reset period of the first subfield, a priming pulse which has a voltage value and a pulse width for causing all of the cells to discharge is applied between the first and second electrodes and after the discharge of all of the cells, the voltage applied between the first and second electrodes is set to zero to thereby erase the wall charge stored in the dielectric layer. In that case, the field for the image display may preferably include the second subfield which is comprised of at least a second reset period in which an erasing pulse having a voltage value and a pulse width for causing only the cells discharged in the preceding subfield to be discharged is applied for allowing only the cells discharged in the preceding subfield to be discharged and thereafter the wall charge stored in the dielectric layer is erased by setting to zero the voltage applied between the first and second electrodes, an addressing period in which a write operation is performed by causing discharge to take place between the first or second electrode and the third electrodes to thereby store the wall charge in the dielectric layer, and a sustained discharge period in which an AC voltage is applied between the first and second electrodes for realizing a sustained discharge by making use of the wall charge stored in the dielectric layer, wherein the second subfield is executed for the cells for which the first subfield has not been executed.

With the driving method described above, the charged particles tend to migrate to the cells in the adjacent lines. Thus, the cells applied with no priming pulse are subjected to the effect of the priming. To say in another way, the priming effect is validated essentially for the whole screen or display panel. Consequently, there can be ensured high reliability for the addressing operation Besides, the quality of picture or image as displayed can be improved.

In a further preferred mode for carrying out the invention, the first or second electrodes of the plasma display panel device may be so arranged as to be connected in common on an odd-numbered line basis or on an even-numbered line basis, wherein the first subfield having the priming pulse may be generated at least once for at least one of the odd-numbered lines and the even-numbered lines.

With the driving method described above, the priming effect can take place substantially uniformly over the whole screen panel, whereby addressing operation can be carried out with high reliability even when luminance in black area is lowered.

In a yet further preferred mode for carrying out the invention, the first or second electrodes of the plasma display panel device may be so designed as to be connected in common on an odd-numbered line basis or on an even-numbered line basis, wherein the first subfield having the priming pulse may be validated for the odd-numbered lines and the even-numbered lines.

With the driving method described above, the priming effect can take place substantially uniformly over the whole screen panel, whereby addressing operation can be carried out with high reliability even when luminance in the area to be displayed in black is lowered.

In a still further preferred mode for carrying out the invention, the priming pulse may be a voltage pulse having a pulse width longer than 2 μsec inclusive, while the erasing pulse may have a pulse width not longer than 1.5 μsec, and wherein the voltage value of the erasing pulse is not higher than that of the priming pulse.

With the driving method described above, the plasma display panel device can be operated stably with high efficiency even when the number of the priming pulses is decreased. Thus, high-quality picture or image can be generated with high contrast while lowering the black luminance level.

For carrying out the invention, the voltage value of the erasing pulse may be so set as not to be lower than a voltage value of a sustaining pulse for realizing the sustained discharge during the sustained discharge period.

With the driving method described above, the plasma display panel device can be operated stably with high efficiency even when the number of the priming pulses is decreased. Thus, high-quality picture or image can be generated with high contrast while lowering the black luminance level.

In a preferred mode for carrying out the invention, the voltage value of the erasing pulse may be so set as not to be lower than a voltage value at which self-extinction discharge takes place.

With the driving method described above, the addressing operation can be performed without fail even when the addressing pulse voltage level is low. The plasma display panel device can operate stably to ensure improved quality of picture or image displayed.

In another preferred mode for carrying out the invention, the erasing pulse and the priming pulse may be generated by a pulse generating means which is constituted by a same switching element and have a same voltage value.

With the arrangement described above, the plasma display panel device can be fabricated at low cost with the driving method being simplified.

In yet another preferred mode for carrying out the invention, one field may be constituted by a plurality of subfields which differ from one another in respect to the sustained discharge period, wherein the subfield having the shortest sustained discharge period and the subfield succeeding thereto are used as the aforementioned first and second subfields, respectively.

The subfield having the shortest sustained discharge period has a highest probability of light emission in the sustained discharge period. Accordingly, the succeeding subfield has a high susceptibility for the priming effect even when the priming pulse is not applied. Thus, the number of the priming pulses can be decreased effectively without exerting adverse influence to the addressing operation. Further, occurrence of addressing failure in the subfield having the shortest sustained discharge period is scarcely recognized visually by the viewer. Thus, pictures or images can be generated with high reliability with the number of times the whole panel write operation is executed being decreased even when the priming pulse is not generated during the subfield having the shortest sustained discharge period.

In a further preferred mode for carrying out the invention, at least one subfield may be interposed between the subfield having the shortest sustained discharge period and the subfield having the second shortest sustained discharge period, wherein the subfield having the second shortest sustained discharge period and the subfield succeeding thereto are selected as the aforementioned first and second subfields, respectively.

With the driving method described above, the whole panel write operation can be omitted in the subfield succeeding to the subfield having the shortest sustained discharge period and the subfield having the second shortest sustained discharge period, respectively, while ensuring favorable contrast in practical application.

In yet another mode for carrying out the invention, each field may be constituted by a plurality of subfields which differ from one another in respect to the sustained discharge period, wherein the subfield having the longest sustained discharge period is employed as the first subfield containing the priming pulse.

With the driving method described above, the addressing operation can be carried out without fail, wherein the whole panel write operation validated in the subfield having the longest sustained discharge period exerts substantially no adverse influence to picture or image as displayed.

In still another mode for carrying out the invention, the subfield having the second longest sustained discharge period may be employed as the first subfield containing the priming pulse.

With the driving method described above, the reliability of the addressing operation can further be enhanced.

Furthermore, in the driving method for the plasma display panel device, one field may repetitionally and successively be executed, wherein the subfield constituting each field and having the longest sustained discharge period and the subfield having the second longest sustained discharge period may be disposed such that a temporal interval intervening between these subfields becomes maximum.

With the driving method described above, the whole panel write operation is performed at a frequency which ensures addressing operation with high reliability, whereby picture or image of improved quality can be obtained while suppressing black display luminance.

Now, according to another general aspect of the present invention, there is provided a plasma display device which includes a panel provided with a plurality of first electrodes and a plurality of second electrodes each of which is covered with a dielectric layer, and a plurality of third electrodes disposed so as to extend orthogonally to at least one of the first and second electrodes mentioned above to thereby form cells, respectively, and reset electrodes disposed at zeroth lines of the first and second electrodes, respectively, a reset electrode driver circuit for applying voltage to the first and second electrodes of the zeroth lines, respectively, a first electrode driver circuit for applying a voltage to the first electrodes, a second electrode driver circuit for applying a voltage to the second electrodes, and a third electrode driver circuit for applying a voltage to the third electrodes.

By virtue of the structure of the plasma display panel device described above, the charge particles generated by applying the priming pulse to the reset electrode are transferred through line sequential scanning. Thus, the whole panel write operation can be realized even when the voltage value of the priming pulse is low, which in turn means that light emission by the electric discharge brought about by the priming pulse can be reduced. Thus, high contrast performance of the plasma display panel device can be realized.

The above and other objects, features and attendant advantages of the present invention will more easily be understood by reading the following description of the preferred embodiments thereof taken, only by way of example, in conjunction with the accompanying drawings.

BRIEF DESCRIPTION OF THE DRAWINGS

In the course of the description which follows, reference is made to the drawings, in which.

DESCRIPTION OF THE PREFERRED EMBODIMENTS

Figure 1:
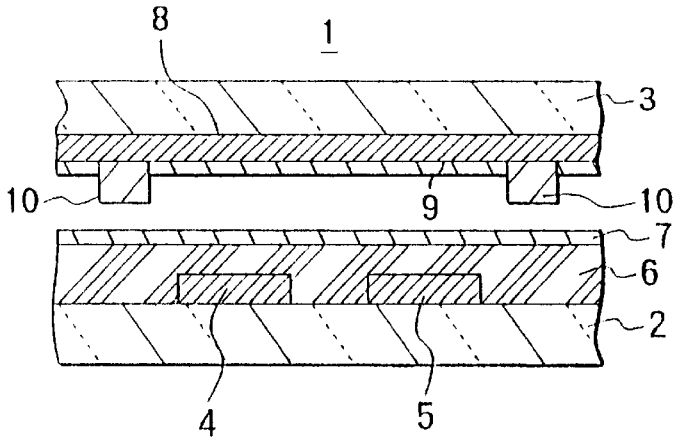
FIG. 1 is a fragmentary sectional view showing a cell structure of a plane discharge type AC plasma display panel device to which a plasma display driving method according to a first embodiment of the invention can be applied.

Now, the present invention will be described in detail in conjunction with what is presently considered as preferred or typical embodiments thereof by reference to the drawings. In the following description, like reference characters designate like or corresponding parts throughout the several views. Also in the following description, it is to be understood that such terms as "row", "column", "top", "bottom", and the like are words of convenience and are not to be construed as limiting terms.

Embodiment 1

FIG. 1 is a fragmentary sectional view showing a cell structure of a plane discharge type plasma display panel device to which a plasma display panel driving method according to a first embodiment of the invention is applied. Referring to the figure, a cell of the plane discharge type plasma display panel device denoted generally by reference numeral 1 includes a front panel glass substrate 2 and a rear panel glass substrate 3 disposed in opposition to each other with a discharge space being interposed or defined therebetween, wherein a first row electrode 4 (Xi) and a second row electrode 5 (Yi) are fixedly mounted on the front panel glass substrate 2. Formed over these first row electrode 4 and the second row electrode 5 is a dielectric layer 6 which is covered with an MgO (magnesium oxide)-layer 7 deposited over the top surface of the dielectric layer 6. On the other hand, disposed fixedly on the rear panel glass substrate 3 in opposition to the row electrodes 4 and 5 are column electrodes 8 (Wj) which extend in the direction orthogonal to the row electrode 4; 5 (Xi, Yi). A phosphor layer 9 is formed over the column electrodes 8. The discharge space defined between the front panel glass substrate 2 and the rear panel glass substrate 3 is filled hermetically with a discharge excitation gas such as a Ne—Xe mixture gas, He—Xe mixture gas or the like.

Figure 2:
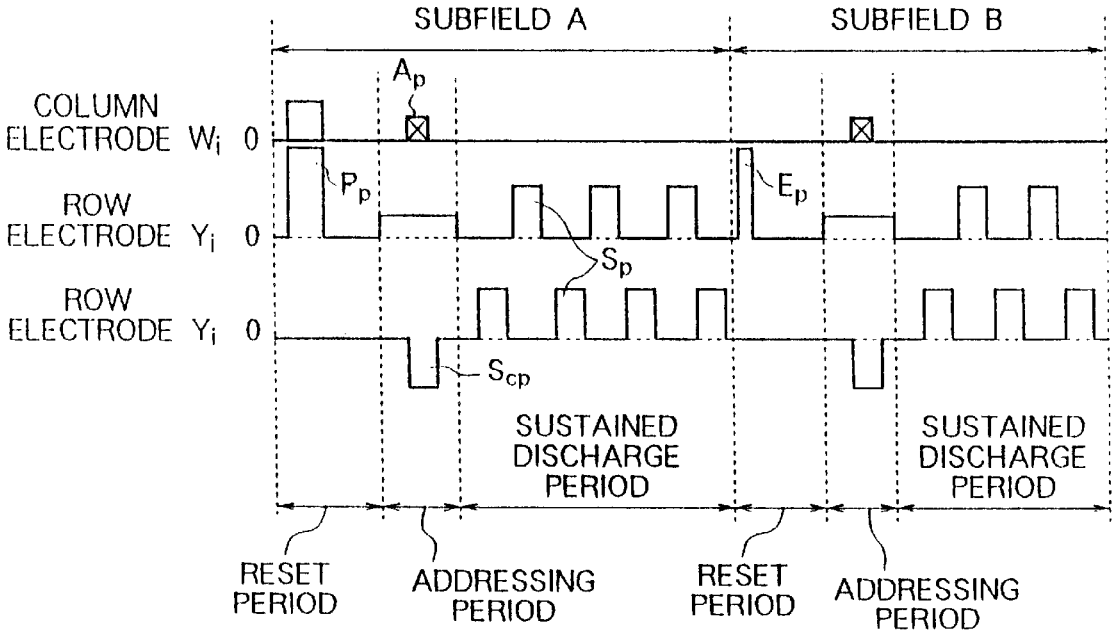
FIG. 2 is a voltage waveform diagram or timing chart for illustrating the plasma display panel driving method according to the first embodiment of the present invention.

FIG. 2 is a voltage waveform diagram (or timing chart, to say in another way) for illustrating the plasma display panel device driving method according to a first embodiment of the invention, wherein there are illustrated waveforms of voltages applied to the column electrode Wj, the first row electrode Xi and the second row electrode Yi, respectively, in this order as viewed from the top of the figure. Further, in FIG. 2, reference character A denotes a subfield in which a priming pulse Pp is applied, while reference character B denotes a subfield in which an erasing pulse Ep is applied. In this conjunction, it is to be noted that the priming pulse Pp is used for effectuating the whole panel write operation and self erasure operation (also referred to as the whole panel write/erase pulse) while the erasing pulse Ep serves for erasing or extinguishing the wall charge. Further, for realizing a sustained discharge, a sustaining pulse Sp is employed. Additionally, a scanning pulse Scp is employed for realizing a scanning operation. Finally, reference character Ap designates an addressing pulse which is applied in dependence on the data content to be displayed. In the plasma display panel device driving method according to the instant embodiment of the invention, the priming pulse Pp may have an amplitude of 290 volts with a pulse width of 3 μsec. Similarly, the erasing pulse Ep may have a pulse height or voltage level of 290 volts with the pulse width of 1 μsec. On the other hand, the sustaining pulse Sp may be set to be about 180 volts with the scanning pulse Scp being about minus (−) 180 volts, while the addressing pulse Ap may be about 60 volts. Of course, these numerical values are only by way of example, and the invention is never restricted thereto. In this conjunction, it should however be mentioned that both the priming pulse Pp and the erasing pulse Ep having the same voltage value are outputted by controlling a switching signal applied to one and the same MOSFET (Metal-Oxide-Semiconductor-Field-Effect Transistor) constituting a driver circuit.

Next, description will be directed to operation of the plane discharge type plasma display panel device on the assumption that one field is constituted by a subfield of first type (hereinafter referred to as the subfield A) which contains the priming pulse Pp mentioned above and a subfield of second type (hereinafter referred to as the subfield B) containing the erasing pulse Ep mentioned previously. At first, it should be noted that the subfields A and B need not be executed in any predetermined order or sequence but may be executed in a given or arbitrarily selected sequence. By way of example, the subfield B may first be executed twice, which is then followed by twice executions of the subfield A, whereupon the subfield B is again executed three times with the subfield A being then executed once again so that one field is realized by executing the subfields eight times in total sum. Of course, the number of the subfields to be executed for realizing one field is never limited to eight. By way of example, for realizing the gradation of 64 levels ($2^6$ gradation levels), the number of times which the subfields are executed may be six, whereas for realization of gradation of 512 levels ($2^9$ gradation levels), the number of times which the subfields are executed may be nine. In other words, it is contemplated with the present invention to realize the same reset states with the wall charge being erased or cleared by executing in combination the subfield A in which the whole panel write operation is performed by applying the priming pulse Pp with the subfield B in which the erasing pulse Ep is applied with the whole panel write being disabled. However, for convenience's sake, it is assumed in the following description that the subfield A is executed at first, being followed by execution of the subfield B.

When the priming pulse Pp is applied to the first row electrode Xi during the subfield A, electric discharge takes places between the first row electrode Xi and the second row electrode Yi regardless of occurrence or absence of discharge in the preceding subfield. In that case, a large amount of wall charge is stored between both the first row electrode Xi and the second row electrode Yi, whereupon the discharge is stoppe. Further, a voltage pulse is applied to the column electrode Wj, which is effective for preventing discharge from occurring between the first row electrode and the column electrode to thereby suppress light emission or radiation within the cell to a minimum. However, it should be mentioned that such application of the voltage pulse to the column electrode Wj may be omitted.

When the priming pulse Pp falls to the state where all the electrodes are at zero volt, the self-extinction discharge takes place due to only the wall charge stored between both the reset electrodes, as a result of which the wall charge are caused to disappear. Subsequently, during the addressing period, the scanning pulse Scp and the addressing pulse Ap are applied to the first row electrodes Xi and the column electrodes Wj, which results in that in each of the cells selected thereby from those disposed in a matrix-like array, discharge takes place between the first row electrode Xi and the column electrode Wj, while at the same time, sustained discharge for write operation occurs between the first row electrode Xi and the second row electrode Yi, as a result of which wall charge is stored on the first and the second row electrodes. On the other hand, no wall charge is formed in the cells which are not selected by the scanning pulse Scp and the addressing pulse Ap. After all the cells have been scanned during the addressing period with the wall charge being stored in the selected cells, all the cells are simultaneously applied with the sustaining pulse Sp during the sustained discharge period. In that case, the sustained discharge is effectuated in those cells having the wall charge stored while the sustained discharge is not validated for the cells having no wall charge stored.

At the end of the sustained discharge period in the subfield A, then the reset period in the subfield B is validated to thereby allow application of the erasing pulse Ep. Although the erasing pulse Ep has a same voltage value as the priming pulse Pp, the pulse width of the former is narrower than the latter, i.e., 1 μsec. Accordingly, only the cells in which the light emission occurred in the preceding subfield can discharge to thereby erase the wall charge. On the other hand, the cells emitted no light in the preceding subfield can remain uninfluenced. Thus, there is established again the state in which all the cells get free of the wall charge, i.e., all the cells are reset. In succession, the addressing period and the sustained discharge period are validated in the subfield A in the same manner as described above.

Figure 3:
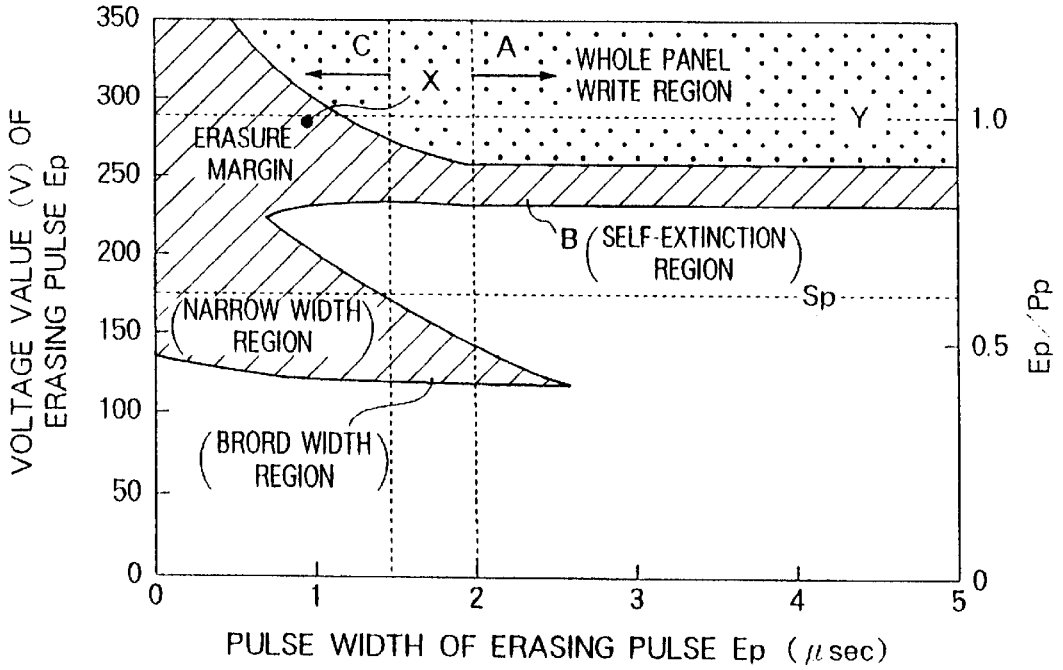
FIG. 3 is a voltage waveform diagram for illustrating ranges of a pulse width and a voltage value of an erasing pulse (Ep) which serves as an erasing pulse in the driving method according to the first embodiment of the invention.

Next, effect or action of the erasing pulse employed in carrying out the invention will be described in detail. With the present invention, it is contemplated as one of the primary objects thereof to make available the erasing pulse Ep which can realize essentially same wall charge reset state as that realized after erasure by the self-extinction erasing operation of the priming pulse Pp. FIG. 3 is a voltage waveform diagram for illustrating experimentally observed relation between ranges of the pulse width and the voltage value of the erasing pulse Ep capable of erasing the wall charge in the case where light emission took place in the preceding subfield and the range of the pulse width and the voltage value of the erasing pulse Ep in which the whole panel write operation can take place similarly to the priming pulse, i.e., light emission occurs when the cell is extinct in the preceding subfield, by varying the pulse width and the voltage value of the erasing pulse Ep, as described hereinbefore by reference to FIG. 2.

In FIG. 3, a hatched region represents the range of the pulse width and the voltage value within which erasure of the wall charge can be validated for the cells discharged in the preceding subfield while no light emission occurs in the cells which remained without discharging in the preceding subfield. On the other hand, the dotted region in FIG. 3 represents a range of the pulse width and the voltage value in which light emission, i.e., whole panel write operation and self-extinction can take place regardless of presence or absence of the discharge in the preceding subfield. Parenthetically, a whole range covering the hatched region and the dotted region represents the erasure range. As can be seen from the figure, so long as the pulse width of the erasing pulse Ep is essentially greater than 2 μsec (region indicated by "A" in FIG. 3), the erasing pulse can act as the priming pulse for triggering light emission even in the extinct cell with a substantially constant voltage value, i.e., regardless of the voltage value of the erasing pulse, whereas in the range of the pulse width shorter than about 2 μsec, the erasing pulse is required to have a greater voltage value as the pulse width becomes shorter or narrower. It can further be seen that there exists a difference between the voltage at which the erasing pulse can serve as the priming pulse and the voltage at which it can serve for the erasure operation even when the pulse width exceeds the value of 2 μsec, which may be explained by the fact that in the case where the wall charge has been stored in the preceding subfield, the self-extinction discharge can take place because of the high voltage value for making the wall charge extinct even when the erasing pulse is at the voltage level incapable of bringing about the priming operation (refer to a region "B" in FIG. 3).

In the case of the plasma display panel device driving method according to the instant embodiment of the invention, it is assumed that the erasing pulse has the voltage value of 290 volts and the pulse width of 1 μsec (see a region "X" in FIG. 3). Accordingly, although the self-extinction discharge can occur in the cells for which the discharge is sustained, the discharge can not occur in the cells for which the discharge has not been sustained (see voltage level "Y" in FIG. 3). Thus, it can be seen from the figure that by employing the priming pulse Pp having the pulse width greater than about 2 μsec and the erasing pulse Ep having the pulse width shorter than about 1.5 μsec (falling within a region "C" in FIG. 3) even with the voltage value same for both the pulses, it is possible to perform the whole panel write operation as well as the succeeding wall charge erasure for thereby resetting all the cells during the subfield A containing the priming pulse Pp while during the subfield B containing the erasing pulse Ep, discharge can be brought about only in the cells in which the wall charge has been stored during the preceding field, to thereby make the wall charge extinct for thereby resetting these cells. Incidentally, the pulse width of the priming pulse should preferably be longer, However, taking into consideration the temporal duration of the subfield from the view point of the display characteristics, the pulse width of the priming pulse may preferably be 50 μsec or so at the most.

On the other hand, within* the range in which the pulse width is narrower or shorter than 1 μsec, e.g. on the order of 0.5 μsec, the range in which the self-extinction can be validated is enlarged significantly, which may be explained by the fact that the self-extinction and the erasure with the narrow-width voltage pulse of the 0.5 μsec are superposed with each other. In this case, the erasing operation can be realized more stably when the erasing pulse has a greater amplitude or voltage value. It is preferred that the voltage value of the erasing pulse is higher than that of the sustaining pulse Sp. Parenthetically, the voltage value of the sustaining pulse Sp employed in the plasma display panel driving method according to the instant embodiment of the invention is represented by "Sp" in FIG. 3. At this juncture, it should be added that the pulse width of the erasing pulse may be set sufficiently small except for zero.

When the pulse width is on the order of 0.5 μsec, the self-extinction and the narrow-width pulse erasure will overlap with each other, making it possible to secure a remarkably wide erasure margin. However, in the case of the plane discharge type plasma display panel, there may arise necessity for resetting the column electrodes which play no part directly in the sustained discharge. More specifically, although the column electrode does not participate directly in the sustained discharge, it is required to discharge the column electrode for the write operation upon addressing or the column electrode is will have to be exposed to the discharge in the sustained discharge phase. Consequently, in the cell undergone the sustained discharge in the preceding subfield, the wall charge is stored in the column electrodes as well. Thus, in the case where the feeble erasure is effected between the adjacent reset electrodes with the narrow-width pulse, the wall charge stored in the column electrodes can not be erased, whereby the addressing voltage will be subjected to undesirable influence after the resetting.

Figure 4:
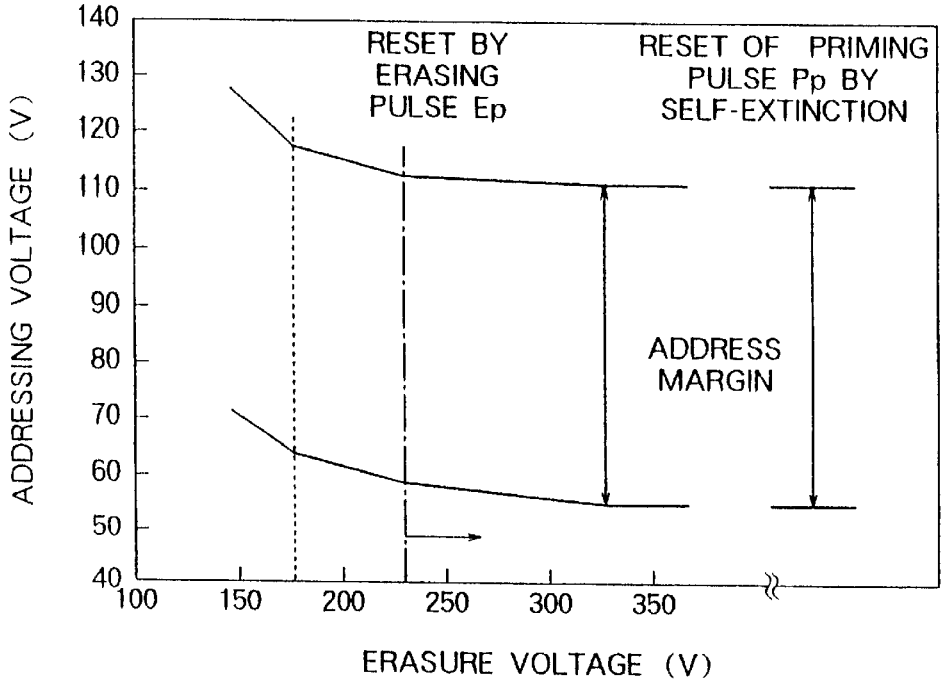
FIG. 4 is a view showing graphically comparison between addressing margins after resettings by an erasing pulse (Ep) and a priming pulse (Pp), respectively.

FIG. 4 is a view showing graphically experimentally observed relations between the addressing voltage and the erasing voltage for illustrating comparatively the voltage range (addressing margin) of the addressing pulse Ap operating normally after the resetting by the self-extinction with the priming pulse Pp of the voltage waveform similar to the one shown in FIG. 2 and the addressing margin after the resetting with the erasing pulse Ep having a pulse width of 0.5 μsec. More specifically, in the experiment conducted by the inventor(s), resetting operation by the erasing pulse Ep was compared with that effected by the priming pulse Pp by changing the voltage value of the erasing pulse Ep. The voltage value of the scanning pulse Scp was maintained constant at minus (–) 180 volts. It can be seen from the figure that the addressing voltage becomes lower as the voltage value of the erasing pulse Ep is higher, approaching to the addressing margin after the resetting by the priming pulse Pp. Further, it can be seen that the voltage value of the erasing pulse Ep at which the addressing voltage becomes remarkably lower is approximately equal to the voltage value at which the self-extinction starts to take place (which voltage value corresponds to a lower limit voltage defining the self-extinction region B shown in FIG. 3 while the change of the erasing voltage is indicated by an arrow "→" in FIG. 4). This voltage value is approximately 1.5 times as high as the lowest discharge sustaining voltage. In this conjunction, it should be mentioned that the lowest or minimum discharge sustaining voltage can be determined as a voltage value at which the sustained discharge can no more occur when the voltage value of the discharge sustaining pulse for the AC type plasma display panel device is lowered gradually. Furthermore, it will be noted that as the voltage value of the erasing pulse Ep becomes lower than the voltage value mentioned above, the addressing voltage increases, deviating from the voltage value at which the resetting operation is triggered by the priming pulse Pp. When the voltage value of the erasing pulse Ep becomes lower than that of the sustaining pulse Sp (in the region at the left side of the dotted line shown in FIG. 4), the addressing voltage increases excessively to make it difficult or even impossible to ensure the stable operation. (For this reason, the voltage value of the erasing pulse Ep should preferably be higher than that of the sustaining pulse Sp, as mentioned previously.) The difficulty of realizing the stable operation may be explained by the fact that when the erasing discharge is of a small scale even with the narrow-width pulse erasure by using the pulse having a pulse width of 0.5 μsec, the amount of the absolute spatial charge becomes too small to neutralize the wall charge stored in the column electrodes. For this reason, it is preferred to set the voltage value of the erasing pulse Ep to be higher than that of the sustaining pulse Sp. More preferably, the voltage value of the erasing pulse Ep should be set higher than the voltage level at which the self-extinction discharge can take place.

As is apparent from the foregoing description, by using the erasing pulse Ep having the pulse width and the voltage value within the preferred range described above, the reset state can be erased in the same manner as the self-extinction by the priming pulse Pp, whereby wide erasure margin and addressing margin can be ensured. Thus, the plane discharge type plasma display panel device can be operated stably under the same driving condition during the addressing period and the discharge sustaining period with the subfield A and the subfield B. Additionally, for the display in black, no light emission takes place at all in the subfield B. Thus, intensity or luminance for the display in black can be lowered, which in turn means presentation of a picture improved in respect to the contrast.

The plane discharge type plasma display panel device according to instant embodiment of the present invention can be implemented in a simplified circuit configuration because the priming pulse Pp and the erasing pulse Ep are of a same voltage and thus can be outputted from one and the same discharge cell by controlling the pulse widths of the priming pulse Pp and the erasing pulse Ep. It goes however without saying that the priming pulse Pp and the erasing pulse Ep are not necessarily to be of the same voltage so long as the conditions described hereinbefore are satisfied.

Furthermore, although it has been described that one field for display is composed of the subfield A and the subfield B, it should be appreciated that the teachings of the invention can equally apply valid even when other subfield(s) is used so long as the subfields A and B are employed at the least.

Embodiment 2

Figure 5:
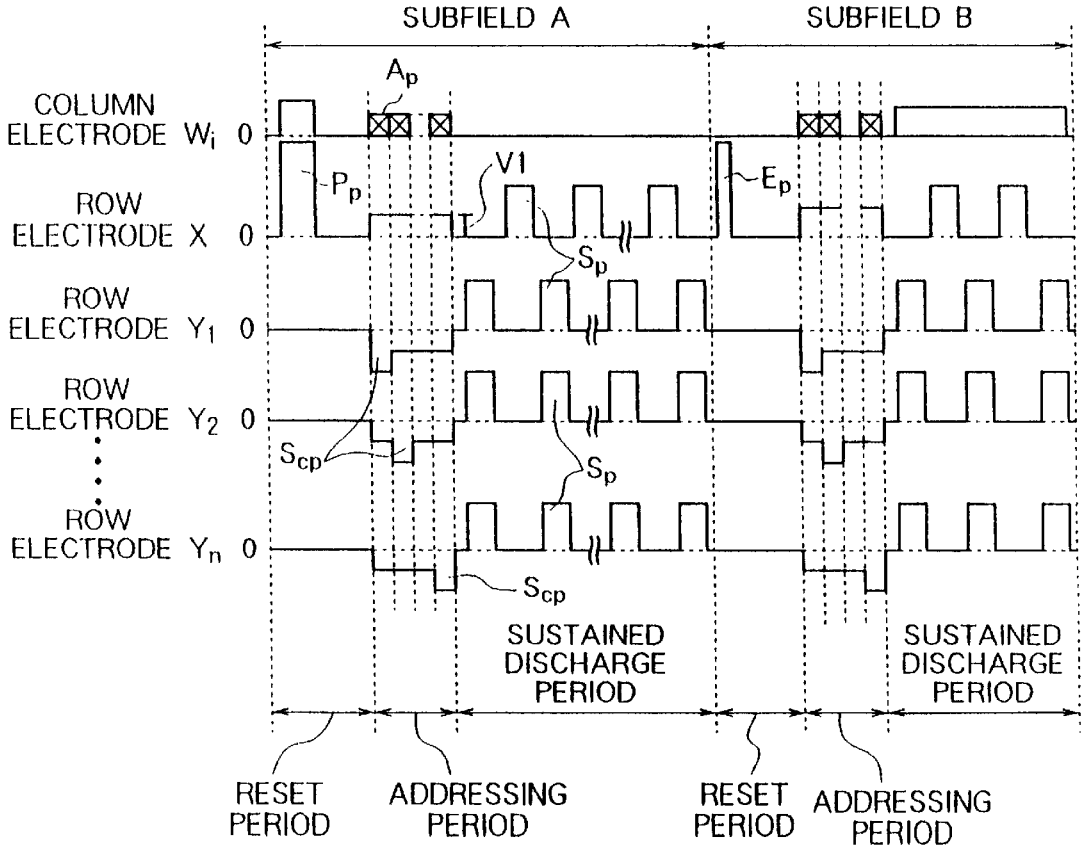
FIG. 5 is a waveform diagram showing voltage waveforms for illustrating a plasma display panel driving method according to a second embodiment of the invention.
Figure 6:
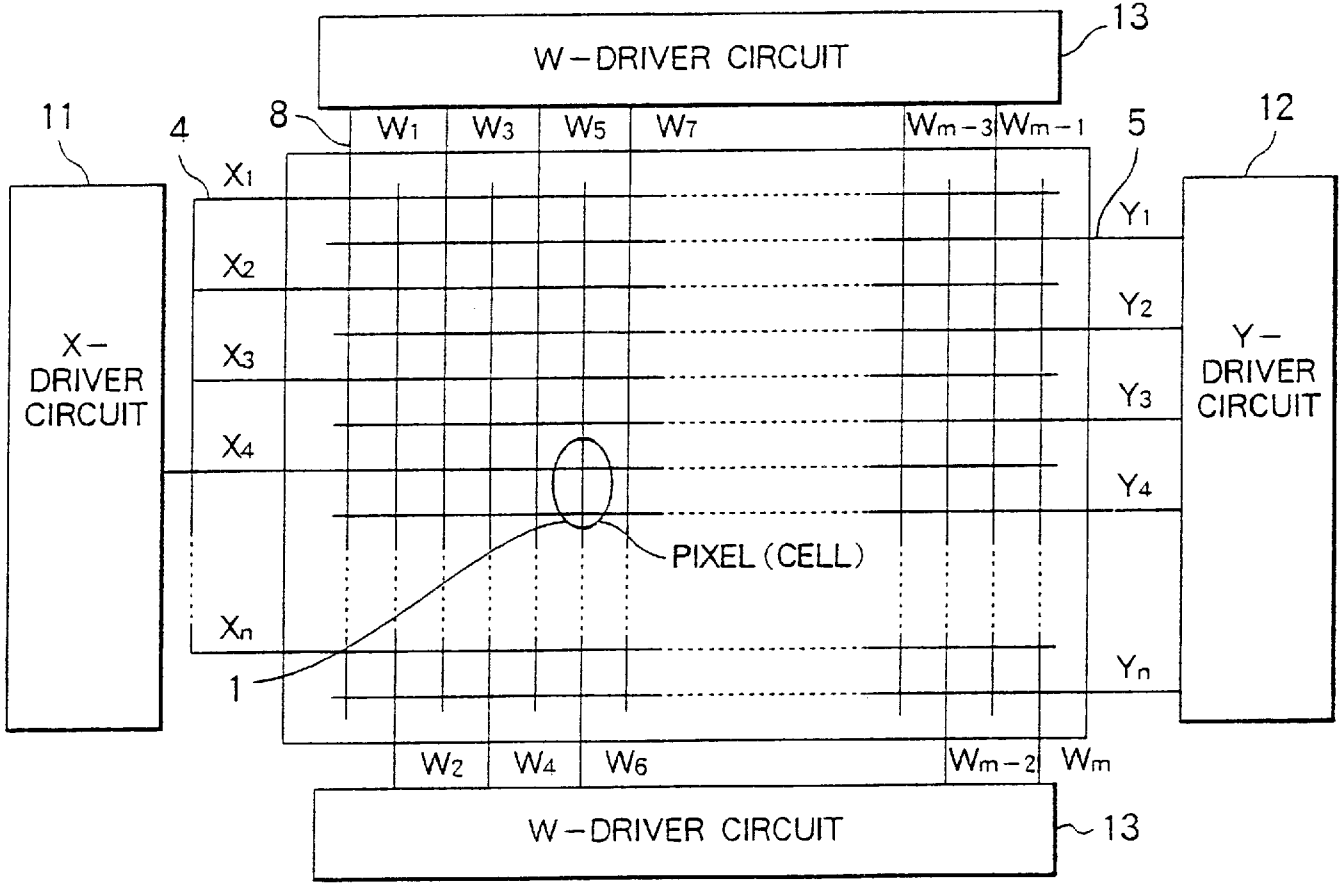
FIG. 6 is a diagram showing a structure of a plane discharge type AC plasma display panel device together with peripheral driver circuits to which a plasma display panel driving method according to the second embodiment of the invention can be applied.

Next, description will be made of the plasma display panel driving method according to a second embodiment of the present invention which differs from the first embodiment primarily in that the line scanning is carried out during the addressing period. FIG. 5 is a waveform diagram showing voltage waveforms for illustrating the plasma display panel driving method according to the instant embodiment. Further, FIG. 6 is a diagram showing a structure of a plane discharge type AC plasma display panel together with peripheral driver circuits for carrying out the plasma display panel driving method according to the second embodiment of the invention. Referring to FIG. 6, first row electrodes X1 to Xn are connected in common to one X-driver circuit 11. On the other hand, second row electrodes Y1 to Yn and column electrodes W1 to Wm are connected to a Y-driver circuit 12 and a W-driver circuit 13, respectively, which are designed to apply driving voltages to the second row electrodes Y1 to Yn and the column electrodes W1 to Wm, respectively, independent of one another. In FIG. 5, there are illustrated voltage waveforms applied to the column electrode Wj, the first row electrode X and the second row electrodes Y1, Y2 and Yn in this order as viewed from the top. In the subfields A and B, resetting operations are performed by using the priming pulse Pp and the erasing pulse Ep, respectively, as in the case of the plane discharge type plasma display panel device described hereinbefore in conjunction with the first embodiment of the invention. Further, the number as well as the sequence of the individual subfields constituting one field may be determined rather arbitrarily, similarly to the case of the first embodiment.

When the priming pulse Pp is applied to the first row electrode from the X-driver circuit during the reset period in the subfield A, discharge takes place in all of the cells over the whole screen panel of the AC-type plasma display device. Subsequently, by resetting the potentials of all the electrodes to zero volt, self-extinction discharge occurs, as a result of which the wall charge is erased or cleared from all the cells, whereby the plasma display panel is reset. In succession, during the addressing period, the scanning pulses Scp are applied to the second row electrodes from the first to n-th lines sequentially, whereby the line scanning operation is effectuated. At this time point, the first row electrode is set to a write sustaining voltage V1 which is incapable of triggering the sustained discharge for writing operation between the first row electrode and the second row electrode. Upon selection by the scanning pulse Scp, the addressing pulse Ap is applied to the column electrode. Then, discharge takes place between the second row electrode to which the addressing pulse Ap is applied, and at the same time, discharge occurs between the first row electrode and the second row electrode, whereby wall charge is formed to be stored. By repeating this operation sequentially, the wall charge is formed in the given cells over the whole screen panel, inclusive of the second row electrodes Y1 to Yn. Thereafter, the operation of the plasma display panel transits to the sustained discharge mode or period. During the sustained discharge period, the sustaining pulses Sp are applied alternately to the X and the second row electrodes Y1 to Yn. Thus, the sustained discharge can be enabled only in the cells selected during the addressing period. After having effectuated the sustained discharge for a desired time, transition is made to the reset period in the subfield B, whereupon the erasing pulse Ep is applied to the first row electrodes, as a result of which discharge can take place only in the cells for which the sustained discharge has been performed in the preceding subfield, whereby these cells get rid of the wall charge, as described previously in conjunction with the first embodiment of the invention. After the resetting operation, all the cells assume the same state, whereupon the addressing operation is performed again.

As will now be appreciated from the foregoing description, although the addressing (writing) is realized by the sequential line scanning during the addressing period, the resetting operation is performed simultaneously for all the cells over the whole screen panel. Thus, the driving method can be simplified while ensuring high contrast, as in the case of the driving method according to the first embodiment of the invention.

Parenthetically, it should be mentioned that in the driving method according to the instant embodiment of the invention, the pulse widths and the voltage values for the priming pulse Pp and the erasing pulse Ep should preferably be selected from the ranges described hereinbefore in conjunction with the first embodiment in order to secure the advantageous effects mentioned previously.

Embodiment 3

Figure 7:
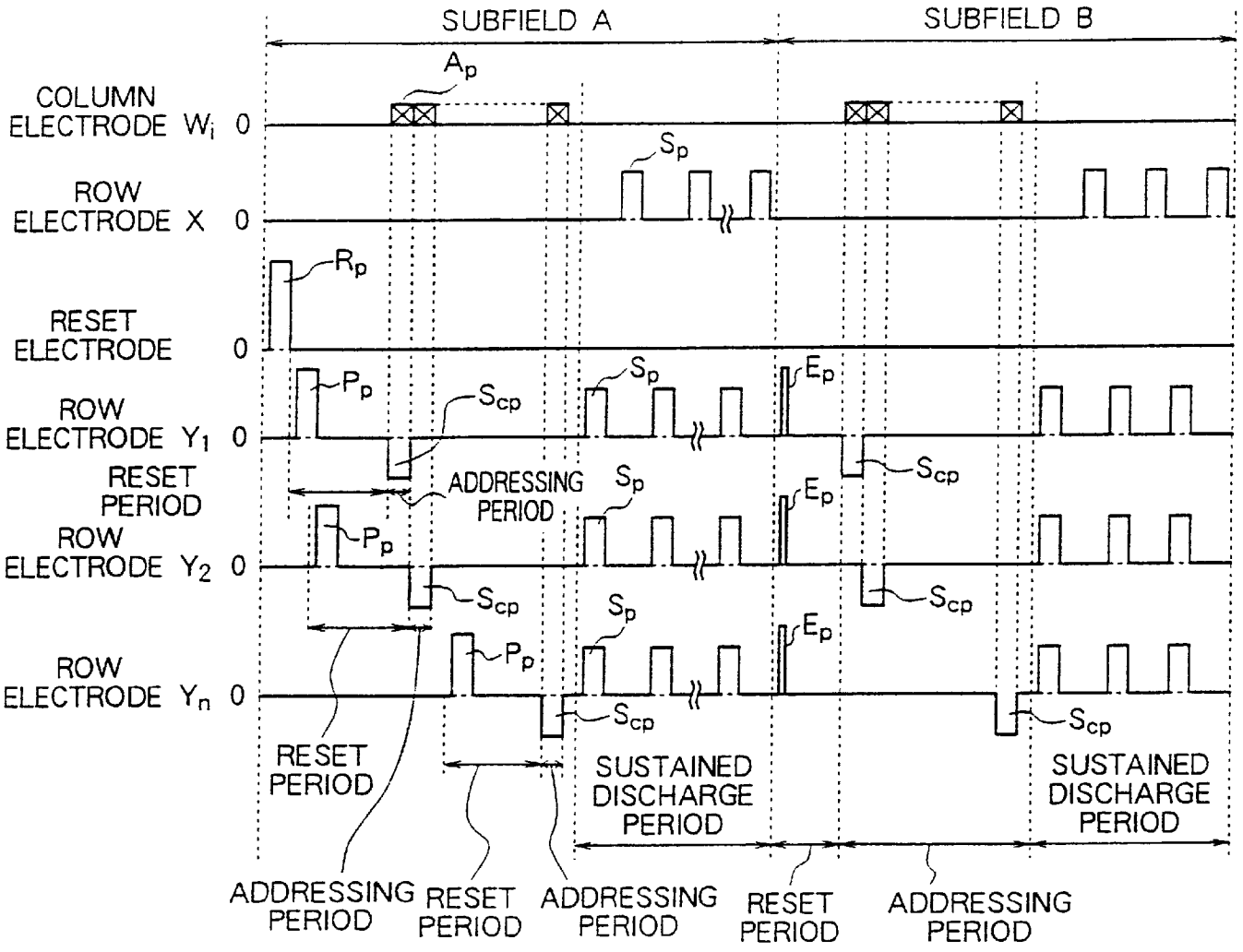
FIG. 7 is a waveform diagram showing voltage waveforms for illustrating a plasma display panel driving method according to a third embodiment of the invention.
Figure 8:
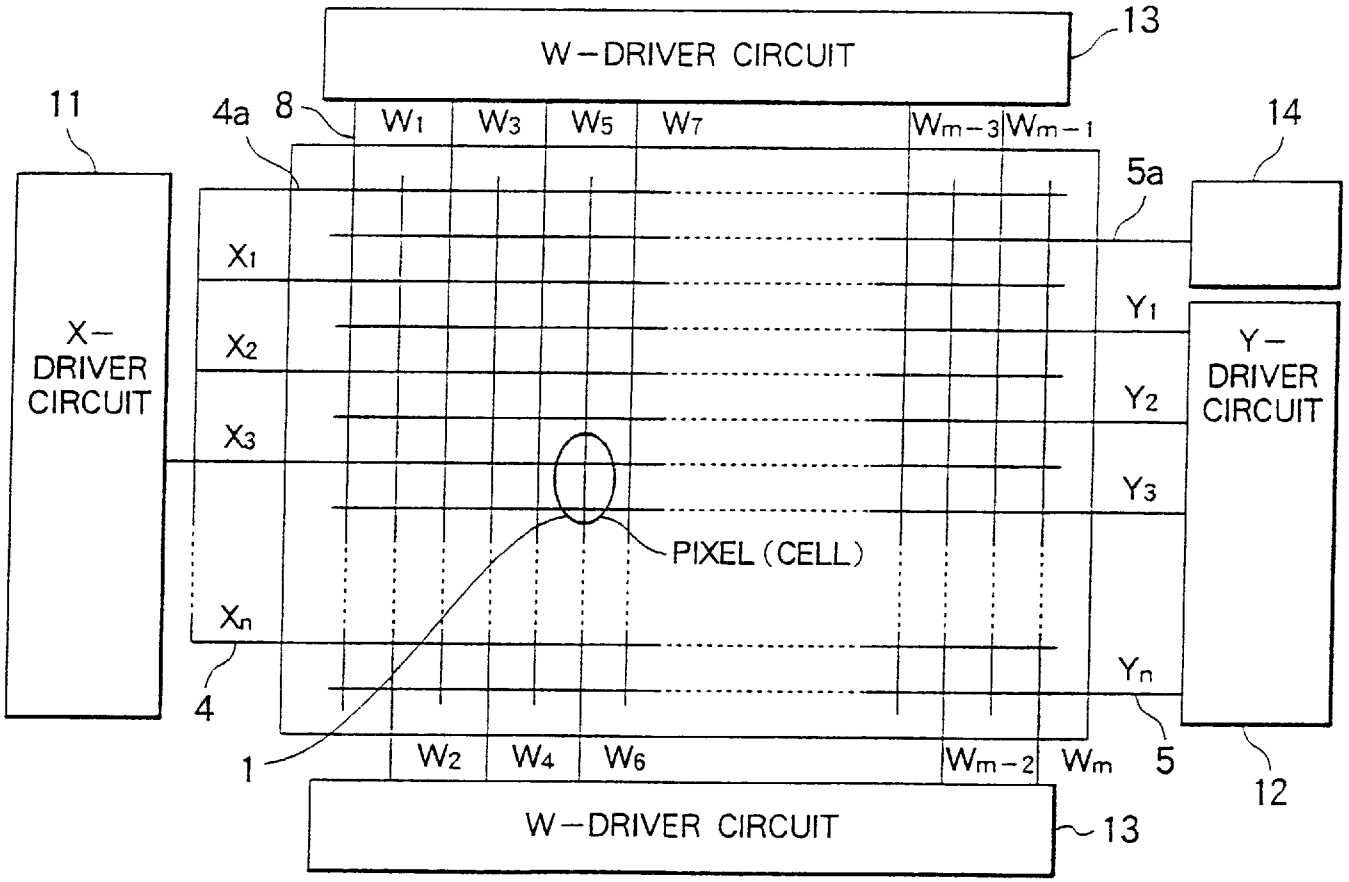
FIG. 8 is a diagram showing a structure of a plane discharge type AC plasma display panel device together with peripheral driver circuits to which a plasma display panel driving method according to a third embodiment of the invention can be applied.

Next, description will be made of the plasma display panel driving method according to a third embodiment of the present invention which differs from the first embodiment primarily in that the priming pulse Pp for resetting is applied through line scanning. FIG. 7 is a waveform diagram showing voltage waveforms for illustrating the plasma display panel driving method according to the instant embodiment. As can be seen in FIG. 8, the first row electrode 4 are connected in common, while the second row electrodes 5 and the column electrodes 8 are provided independent of one another. Further, it can be seen from FIG. 8 that one electrode is additionally provided at zeroth lines of the first row electrode 4 and the second row electrode 5, respectively, while a reset electrode 4*a* is provided for the first row electrode with a reset electrode 5*a* being provided in association with the second row electrode, wherein the reset electrodes 4*a* and 5*a* constitute a reset electrode couple or pair. The reset electrode 5*a* is connected to a reset electrode driver circuit 14 which is designed for driving the reset electrode 5*a*. Incidentally, the reset electrode pair belongs to the set of the row electrodes, although the former plays no role in generation of picture of image to displayed.

In the case of the plane discharge type plasma display panel according to the instant embodiment of the invention, the priming pulse Pp for validating the reset operation is applied through line scanning, and thereafter the scanning pulse Scp is applied also by line scanning. Thus, the reset period and the address period are distinguished from each other on a line-by-line basis, not for the whole screen of the plasma display panel. On the other hand, the sustained discharge period is validated simultaneously for the whole panel or screen after the addressing. The priming pulse Pp may be applied at a low voltage because after the discharge of adjacent lines, charged particles tend to migrate into the peripheral cells. By taking the advantage of this phenomenon, the line scanning is performed with the priming pulse Pp of a low voltage value. With the lowering of the voltage value of the priming pulse Pp, the quantity of light emission for the whole panel write operation can be suppressed, making it possible to lower further the luminance in the area to be displayed in black. In this conjunction, it is noted that because the reset electrode pair for the zeroth line can not acquire the charged particles from the adjacent line, the reset electrode pair requires higher voltage value than that for the scanning priming pulse. As an alternative, the structure itself may be modified such that the interelectrode distance between the paired reset electrodes on the zeroth line is narrower than the interelectrode distance between the paired first row electrode and second row electrode used for the display, to thereby lower the firing potential so that the discharge can be started with the same voltage value as that of the scanning priming pulse Pp. In the following description, it is assumed that the pair of reset electrodes are implemented in the same structure as the first and second row electrodes, respectively. More specifically, it is assumed that on the zeroth line irrelevant to a display, one electrode of the pair is connected in common with the first row electrode while the other electrode of the pair is connected to the reset electrode driver circuit.

Operation of the plasma display panel driven according to the instant embodiment of the invention will be described by reference to FIG. 7 which shows waveforms of voltages applied to the column electrode Wj, the first row electrode X, the reset electrode and the second row electrodes Y1, Y2 . . . , Yn in this order as viewed from the top in the figure. Applied to the reset electrode is a resetting pulse Rp from the reset electrode driver circuit. The resetting pulse Rp is set to a higher voltage value than that of the priming pulse Pp. In the subfield A, resetting operation is effectuated by the priming pulse Pp, while in the subfield B, reset operation is realized by resorting to the erasing pulse Ep, as in the case of the preceding embodiments of the invention. The number and the sequence of the subfield A and the subfield B as combined may be determined rather arbitrarily, as in the case of the preceding embodiments.

When the subfield A is started at the end of the preceding subfield, the priming pulse Pp is applied to the reset electrode 5*a* from the reset electrode driver circuit 14, which results in that discharge occurs between the reset electrodes 4*a* and 5*a*. The charged particles produced due to this discharge will migrate to the adjacent cells, to reach the region of the row electrode on the first line. Upon falling of the resetting pulse Rp, the priming pulse Pp is applied to the second row electrode 5 (Y1) on the first line from the Y-driver circuit 12, incurring discharge of all the cells belonging to the first line, whereby resetting is realized by the self-extinction. In this manner, the priming pulse Pp is applied by the line scanning while transferring the charged particles to the n-th line which is the final line of the screen.

The scanning pulses Scp for selection of the individual lines in the matrix array are applied sequentially after lapse of several tens microseconds from the application of the priming pulse Pp to the individual lines. Immediately after the application of the priming pulse Pp, a large amount of the spatial charge remains within the cells. Accordingly, when the addressing is performed in this state, the address voltage tends to become lower because the discharge can readily occur. Such tendency is favorable for lowering the addressing voltage. However, there makes appearance difference in the addressing voltage in the subfield B in which the erasing pulse Ep is applied instead of application of the priming pulse Pp. For this reason, the scanning pulse Scp should preferably be applied after lapse of 50 $\mu$sec or more from the application of the priming pulse Pp.

In this manner, by scanning all the lines for thereby storing the wall charge at the desired cells and then applying the discharge sustaining pulses simultaneously for all the cells over the whole panel, the sustained discharge can be realized. Subsequently, in the subfield B, the erasing pulse Ep is applied to all the second row electrodes Y1 to Yn simultaneously over the whole screen panel, to thereby erase the wall charge for realizing the resetting. The erasing pulse Ep may be applied by the line scanning process. However, because the influence of the charged particles of the adjacent line is not made use of, the erasing pulse Ep should preferably be applied simultaneously for all the cells over the whole panel.

As can be appreciated from the foregoing description, by providing the reset electrodes which do not participating in the display generation and generating the priming pulse at a lower voltage than the reset pulse by making use of the resetting discharge between the reset electrodes, while transferring the charged particles generated by the priming pulses through the line scanning (line-sequential scanning), it is possible to validate the write operation for the whole panel even when the voltage value of the priming value is low. Thus, the light emission due to the discharge triggered by the priming pulse can be suppressed, while making it possible to realize high contrast.

In the case of the plane discharge type plasma display panel according to the third embodiment of the invention, the pulse widths and the voltage values of the priming pulse Pp and the erasing pulse Ep may preferably be so selected as to fall within the ranges described hereinbefore in conjunction with the first embodiment of the invention for thereby ensuring similar advantageous effect.

Embodiment 4

Figure 9:
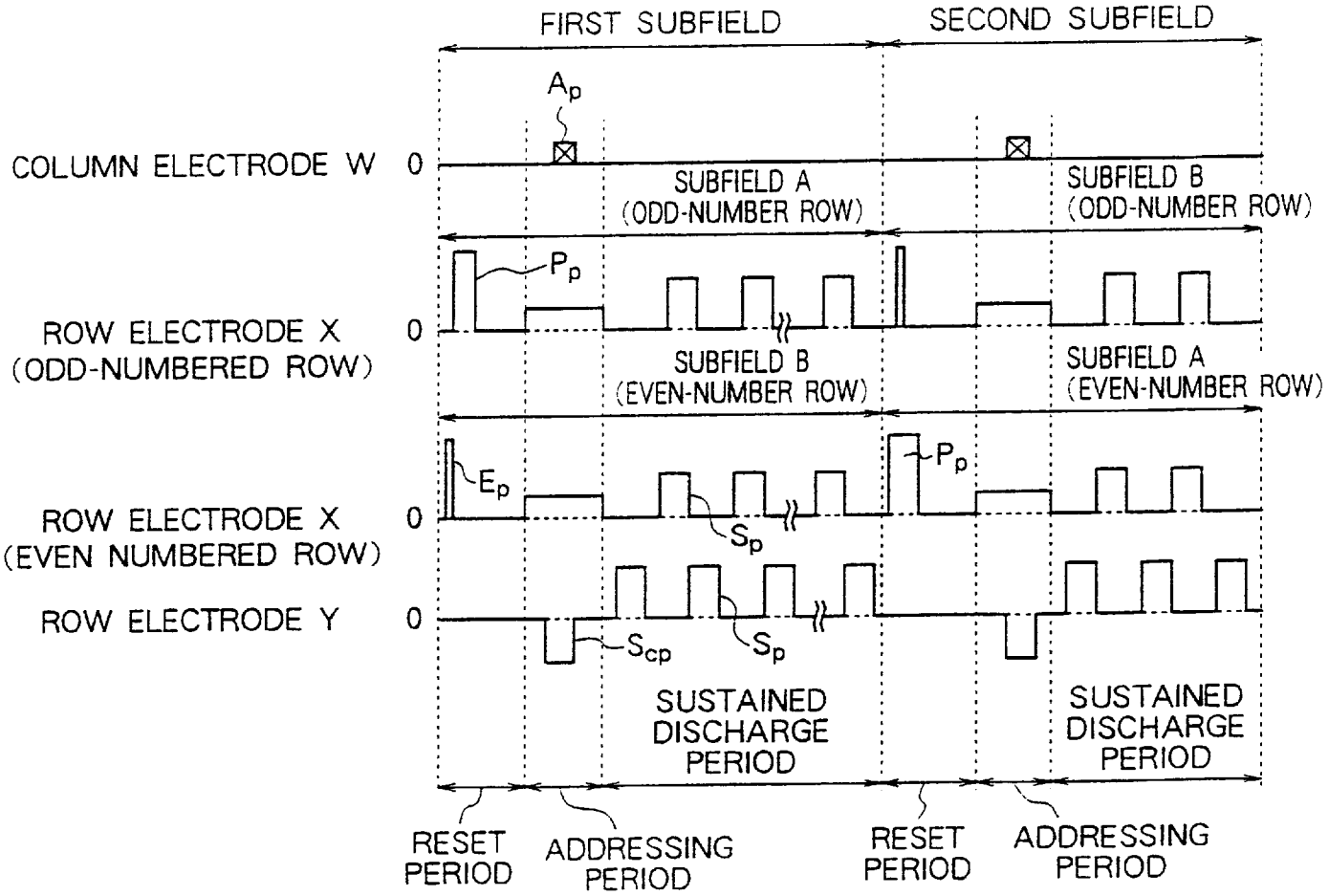
FIG. 9 is a waveform diagram showing voltage waveforms for illustrating a driving method for a plane discharge type plasma display panel device according to a fourth embodiment of the present invention.
Figure 10:
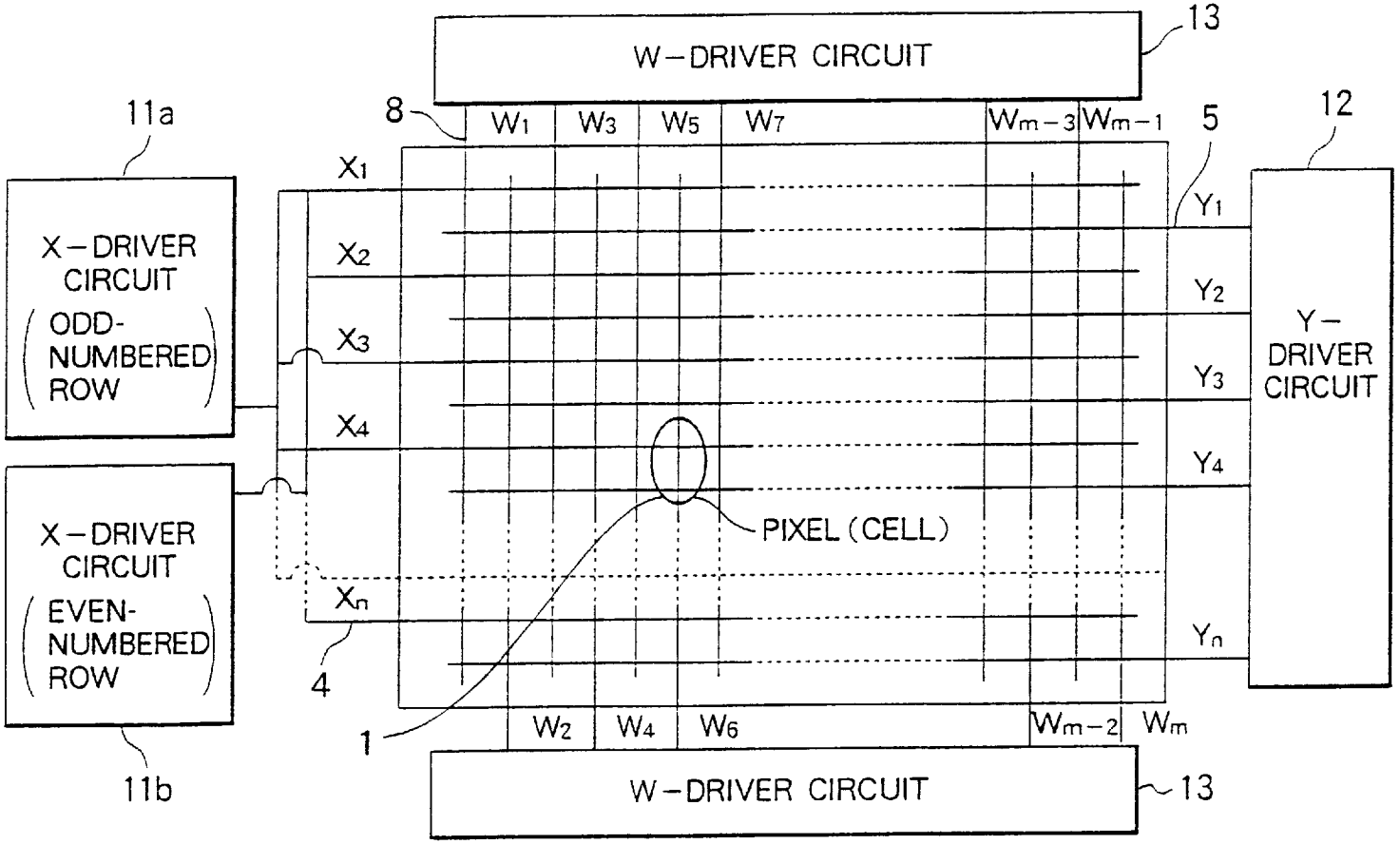
FIG. 10 is a circuit diagram showing schematically a circuit configuration of a plane discharge type plasma display panel device inclusive of peripheral driver circuits to which the driving method according to the fourth embodiment of the invention can be applied.

Next, description will be made of the plasma display panel driving method according to a fourth embodiment of the present invention. FIG. 9 is a waveform diagram showing voltage waveforms for illustrating a driving method for a plane discharge type plasma display panel according to the instant embodiment of the invention, and FIG. 10 is a circuit diagram showing schematically a circuit configuration of the plane discharge type plasma display panel inclusive of peripheral driver circuits. Referring to FIG. 10, the first row electrodes 4 of the plane discharge type plasma display panel device are classified into an odd-numbered line group and an even-numbered line group with the first row electrodes 4 in each of the groups being connected in common, wherein the first row electrodes 4 belonging to the odd-numbered line group are connected to an odd-numbered row electrode X-driver circuit 11*a*, while the first row electrodes 4 belonging to the even-numbered group are connected to an even-numbered row electrode X-driver circuit 11*b* so that the odd-numbered line electrodes and the even-numbered line electrodes can be applied with voltages independent of each other.

Intrinsically, the priming pulse is destined to be employed for generating a minute amount of charged particles within the discharge cells with a view to suppressing addressing failure in the addressing operation so that the write discharge can take place without fail. Accordingly, the discharge to be brought about by the priming pulse Pp should preferably be suppressed to a necessary minimum at which the addressing can be effected without fail.

According to the teachings of the invention incarnated in the instant embodiment of the invention, the subfield in which the priming discharge is performed for the odd-numbered line electrodes and the even-numbered line electrodes is repeated alternately with the subfield in which the priming discharge is not performed. With this driving method, the charged particles generated by the priming discharge can propagate or migrate to the adjacent lines. Thus, the lines for which the priming discharge is not performed are supplied with the charged particles, as in the case of the driving methods described hereinbefore. To say in another way, when the priming discharge is brought about for the even-numbered lines, the charged particles generated thereby will be supplied or fed to the even-numbered lines. Thus, the priming effect can be made available.

Next, referring to FIG. 9, description will be made of the operation of the plane discharge type plasma display panel driven by the driving method according to the instant embodiment of the invention. During the first subfield period, the subfield A is executed for the odd-numbered line electrodes of the first row while for the even-numbered line electrodes of the second row, the subfield B is executed. In this manner, the subfields during which the priming pulse Pp and the erasing pulse Ep are applied, respectively, are executed separately for the odd-numbered lines and the even-numbered lines, respectively, which are repeated sequentially. Even when the subfield A and the subfield B are separated for the odd-numbered lines and the even-numbered lines in this manner, the charged particles will be supplied to the adjacent lines for which the priming discharge has not been effected because the charged particles given birth to by the discharge brought about by the priming pulse can migrate to the adjacent lines. Assuming, by way of example, that the priming discharge is conducted from the odd-numbered lines, the charged particles generated thereby are supplied to the even-numbered line electrodes as well. Thus, it can be understood that the simultaneously write operation is performed with the priming pulse on the odd-numbered line basis or on the even-numbered line basis according to the plasma display panel driving method now under consideration. Further this reason, the discharge of concern should rather be referred to as the priming pulse write operation than the whole panel write operation. However, it should be appreciated that except for the difference mentioned above, the plasma display panel driving method according to the instant embodiment of the invention is essentially same as the preceding embodiments in respect to the actions and effects as achieved.

With the plasma display panel driving method for effectuating the priming discharge separately for the odd-numbered line electrodes and the even-numbered line electrodes in the alternating manner, as described above, luminance of display in black can be reduced about to a half when compared with the whole panel write operation for performing the priming discharge for all the lines. Thus, there can be provided a display panel device which is improved in respect to the contrast by ensuring adequately the priming effect as desired.

Figure 11:
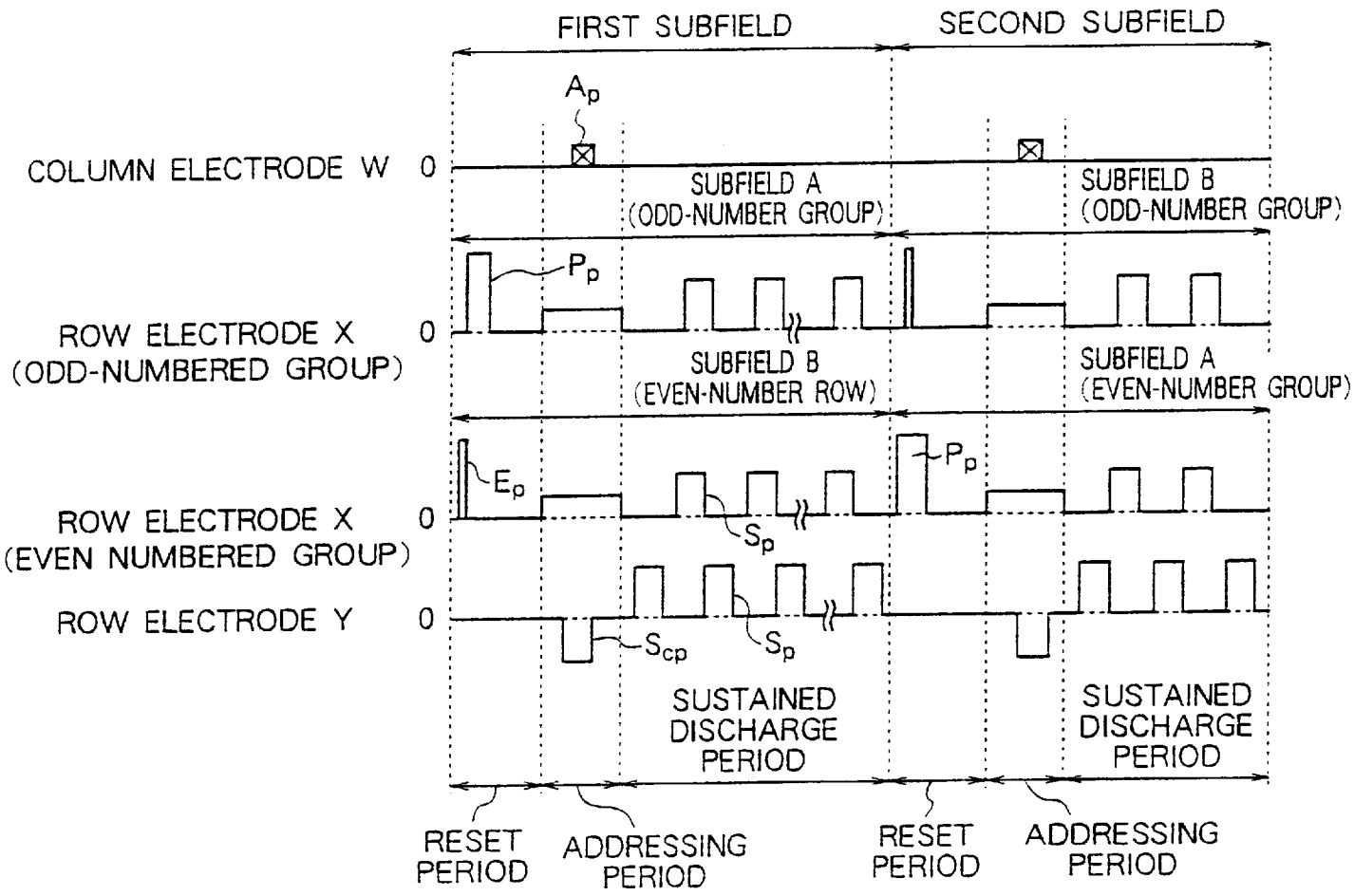
FIG. 11 is a waveform diagram showing voltage waveforms for illustrating a driving method for another plasma display panel device according to the fourth embodiment of the invention.
Figure 12:
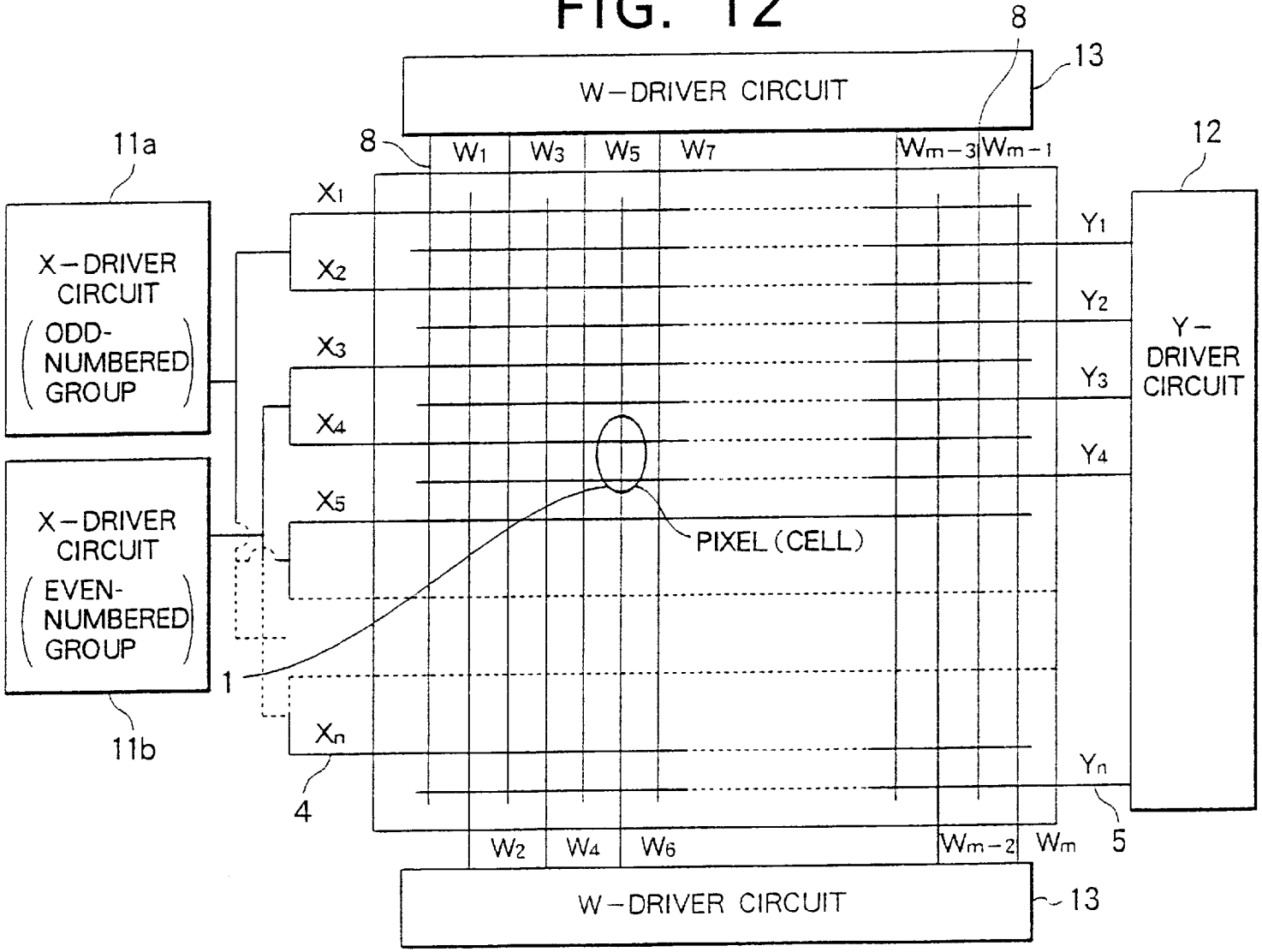
FIG. 12 is a view showing another structure of a plane discharge type AC plasma display panel device which is adapted to be driven by the plasma display driving method according to the fourth embodiment of the invention, together with peripheral driver circuits therefor.

In the plasma display panel driving method according to the instant embodiment of the invention, the reset electrodes are classified into the odd-numbered line group and the even-numbered line group, wherein the priming discharge is performed for every other line electrodes on a subfield-by-subfield basis. It should however be mentioned that similar advantageous effects can be obtained by effectuating the priming discharge for every second or every third line of the reset electrodes in every second or every third subfield. Additionally, a plurality of lines may be classified into groups, wherein the priming discharge may be performed separately for the odd-numbered line groups and for the even-numbered line group. In this conjunction, FIG. 11 shows voltage waveforms in the case of a plasma display panel driving method according to which each group is constituted by two electrode lines, wherein the priming discharge is performed for every second line. On the other hand, FIG. 12 shows schematically a structure of the plasma display panel driving method adapted to be driven by the method mentioned above, together with peripheral driver circuits therefor.

Furthermore, although it has been described that the odd-numbered lines and the even-numbered lines are alternately repeated such that during a given field period, the odd-numbered lines fall within the subfield A while the even-numbered lines are subjected to the processing in the subfield B, which is then followed by a period in which the odd-numbered lines fall within the subfield B with the even-numbered lines falling within the subfield A, the invention is not limited to such sequence. By way of example, such driving method can equally be adopted according to which the subfield A is realized only for the odd-numbered lines with the subfield B being executed only for the even-numbered lines. Besides, such modification is equally possible that the subfield B is executed only for the even-numbered lines whereas for the odd-numbered lines both the subfield A and the subfield B are validated. Additionally, it goes without saying that the odd-numbered lines and the even-numbered lines may be replaced by each other.

In the plasma display panel driving method according to the instant embodiment of the invention, the subfields A and B are same as those adopted in the plasma display panel driving method according to the first embodiment of the invention. It goes however without saying that the driving method according to the instant embodiment of the invention can also be carried out by using the voltage waveform patterns adopted in the driving methods mentioned in conjunction with the second embodiment (FIG. 5) and the third embodiment (FIG. 7) of the present invention.

Furthermore, although it has been described that in the case of the plasma display panel driving method according to the instant embodiment, both the priming pulse and the erasing pulse are employed. However, the teaching of the invention incarnated in the fourth embodiment thereof resides in that the priming pulse is applied to every other line electrodes or every several-th line electrodes, to say in general, for thereby lowering luminance of display in black to a half or to one several-th. So long as this condition is met, any further restriction may be imposed with regards to the priming pulse and the erasing pulse.

The conditions imposed on the priming pulse and the erasing pulse are similar to those described hereinbefore in conjunction with the first embodiment of the present invention.

Embodiment 5

Figure 13:
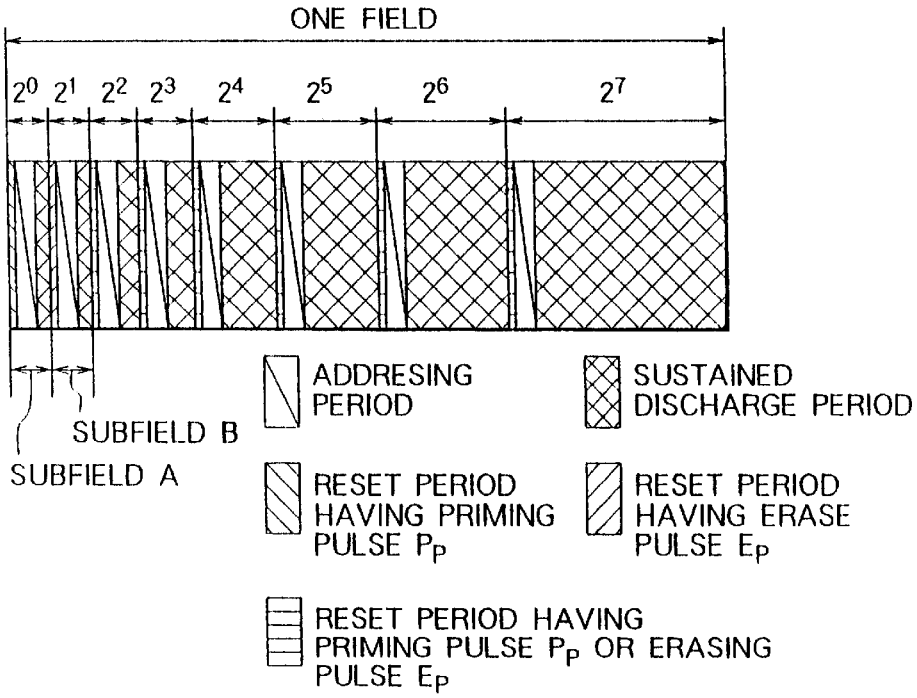
FIG. 13 is a diagram a structure of subfields which are generated within one field by employing a plasma display panel driving method according to a fifth embodiment of the present invention.

A fifth embodiment of the present invention will now be described. FIG. 13 is a diagram for illustrating a plasma display panel driving method according to the fifth embodiment of the invention and shows a structure of subfields within one field in a display with gradation of 256 levels. In the description which follows, it is assumed that the reset period is effectuated simultaneously over the whole panel or screen (as in the case of the first and second embodiments). However, it should be mentioned that the teaching of the invention incarnated in the instant embodiment can find application equally to the driving method in which the resetting operation is carried out by scanning the lines with the priming pulse Pp as described hereinbefore in conjunction with the first and second embodiments. Referring to FIG. 13, the subfield number "$2^n$" (where n=0, . . . , 7) represents the subfield having the light emission period of a corresponding ratio. More specifically, the subfield designated by "$2_0$" has a shortest sustained discharge period, while the subfield designated by "$2^7$" has a longest sustained discharge period. For the convenience of description, the subfield having the shortest sustained discharge period will be referred to as the LSB (Least Significant Bit) subfield while the subfield having the longest sustained discharge period is referred to as the MSB (Most Significant Bit) subfield. Further, similarly to the driving methods according to the preceding embodiments of the invention, the whole panel write operation is first performed in the subfield A by using the priming pulse Pp, being followed by the reset operation for erasing the wall charge under the self-extinction discharge, while in the subfield B, only those cells having charge stored therein are discharged by using the erasing pulse Ep to thereby erase the wall charge. In the case of the example illustrated in FIG. 13, the LSB subfield is used as the subfield A while the subfield succeeding to the LSB subfield is adopted as the subfield B in which the priming discharge is not effected. Any one of the six remaining subfields may serve as the subfield A or the subfield B. Further, although the individual subfields are shown in the ascending order of the LSB to the MSB (i.e., in the sequence starting from the subfield having the shortest sustained discharge period to the subfield of the longest sustained discharge period). However, the invention is never restricted to any definite sequence of the individual subfields.

As described previously in conjunction with the preceding embodiments of the invention, in the plane discharge type plasma display panel, there can be generated an image or picture display which provides practically no problem even when the priming operation is not performed on a subfield-by-subfield basis. As the number of the subfields in which the priming operation is effected becomes smaller, luminance in the area to be displayed in black can be mode lower, whereby contrast of pictures as generated on the plane discharge type plasma display panel device can be improved. On the other hand, the purpose of the priming operation is to ensure high reliability for the addressing. Accordingly, by effectuating the priming operation on a subfield-by-subfield basis, reliability of the addressing can be enhanced correspondingly. In this manner, generation of a picture of improved contrast is reciprocal to high reliability of to addressing. In other words, satisfaction for one of the requirements mentioned above can be realized at the expense of the other. By contrast, in the case of the plasma display panel driving method according to the instant embodiment of the invention, probability of light emission in the LSB subfield is ½ even when the subfield B is arrayed in succession to the LSB subfield. (Incidentally, in the conventional animated picture display, probability of light emission in the LSB subfield is ½.) Accordingly, by securing high reliability for the addressing operation for the LSB subfield employed as the subfield A, there is made available a sufficient amount of charged particles in the succeeding subfield with a probability of ½. This in turn means that even when the subfield B in which the whole panel write operation is not effected follows the LSB subfield, the addressing operation can be performed with high reliability which is comparable to that ensured by the whole panel write operation effected with the probability of ½. In other words, at least in the subfield which follows immediately the LSB subfield, reliability of the addressing operation can be secured notwithstanding of absence of the priming pulse and at the same time the number of the priming pulses can be decreased.

By way of example, when the AC type plasma display panel is employed in a television receiver, light emission changes constantly from one to another subfield because of constant change of displayed pictures as generated. Accordingly, applying the plane discharge type plasma display panel device as well as the driving method therefor according to the instant embodiment of the invention to the television receivers or the like, the reliable addressing operation can be secured while allowing the number of the priming pulses to be decreased.

Because the LSB subfield is shortest in the time duration or period, the charged particles brought about by the whole panel write operation performed in the LSB subfield can remain in a sufficient amount for ensuring the reliable addressing in the succeeding subfield even in the case of absence of light emission during the preceding LSB subfield.

As will be appreciated from the above, during the LSB subfield in which the sustained discharge period is shortest, the probability of securing the priming effect is high in the succeeding subfield because of highest probability of light emission during the sustained discharge period in the LSB subfield, whereby adverse influence to the addressing operation can be suppressed to a minimum. Thus, the plasma display panel driving method according to the fifth embodiment of the invention is advantageous in that the number of times the priming pulse is to be applied can effectively be deceased while ensuring enhanced contrast for the pictures as displayed.

Embodiment 6

In the case of the plane discharge type plasma display panel and the driving method therefor described above in conjunction with the fifth embodiment of the present invention, application of the priming pulse Pp is omitted in the subfield succeeding to the LSB subfield in which the probability of light emission is as high as on the order of ½. In this conjunction, it is also noted that in the second subfield which follows the LSB subfield having the shortest sustained discharge period or duration, the probability of light emission is as high as ¼. Thus, in the driving method for the plane discharge type plasma display panel, the addressing operation can essentially be secured even when the priming pulse Pp is not applied in the subfield which follows the subfield having the second shorter sustained discharge in succession to the LSB subfield Thus, it is proposed according to the teachings of the invention incarnated in the instant embodiment thereof that one or more subfields are placed between the LSB subfield and the second subfield succeeding thereto (i.e., subfield having the sustained discharge period shortest next to that of the LSB subfield), wherein the LSB subfield and the second subfield mentioned above are employed as the subfield A with the subfields succeeding to the second subfield being allocated as the subfield B, with a view to lowering luminance in display in black while ensuring contrast of the image which provides no problems in practical application.

Embodiment 7

Figure 14:
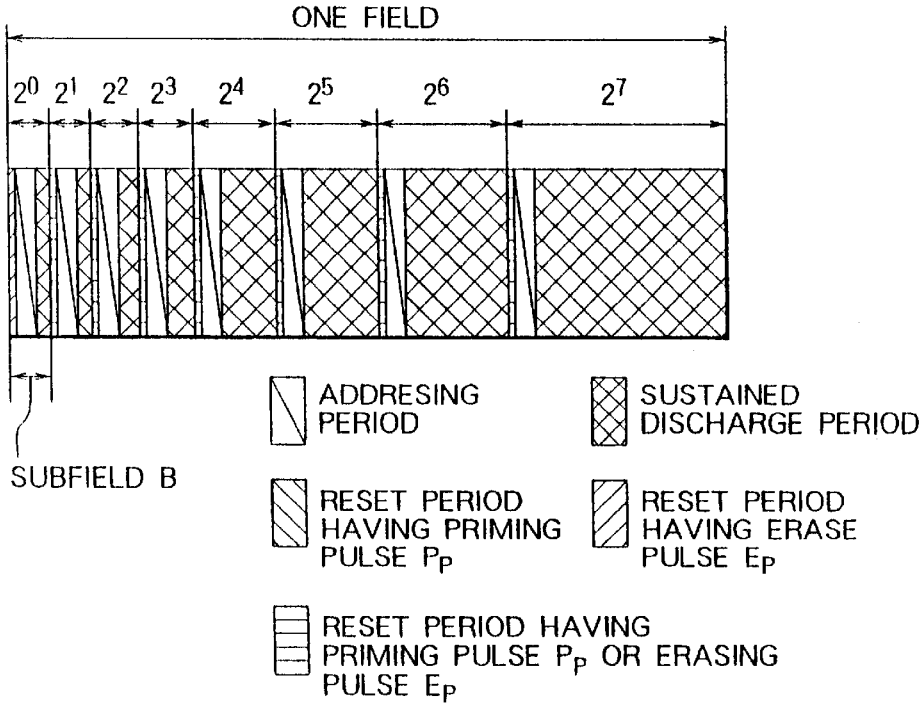
FIG. 14 is a diagram showing a structure of subfields which are generated within one field by employing a plasma display panel driving method according to a seventh embodiment of the present invention.

A seventh embodiment of the present invention will be described by reference to FIG. 14 which is a view showing a driving method for a plane discharge type plasma display panel device according to the seventh embodiment and shows a structure of subfields within other one field for the 256-gradation display. According to the instant embodiment of the invention, the LSB subfield is employed as the subfield B in which the whole panel write operation is not performed. The other subfields may be constituted by the subfield A and/or the subfield B, as described hereinbefore.

The LSB subfield has the shortest sustained discharge period in the field. More specifically, the LSB subfield is lowest in luminance and exerts less influence to the picture or image as displayed even when the addressing operation is failed. By way of example, in the case of a plasma display panel exhibiting maximum display luminance of 256 $cd/cm^2$, the LSB subfield is sufficient to share luminance of 1 $cd/m^2$. In general, in the ordinary image display, it is rare to display the image or picture with maximum luminance. Accordingly, it is assumed that the display is to be generated at luminance of 100 $cd/m^2$. In that case, even when the addressing for the LSB subfield is failed without being accompanied with light emission during this subfield, luminance loss amounts to only 99 (=100−1) $cd/m^2$, which loss can not visually be recognized. Accordingly, the subfield in which no priming discharge is performed may be allocated to the LSB subfield for thereby enhancing the contrast without incurring any appreciable degradation in the quality of image.

From the foregoing description made in conjunction with the fifth and sixth embodiments, it can be seen that the subfields of different types are allocated to the LSB subfield and the succeeding subfield (i.e., subfield succeeding to the LSB subfield). More specifically, when the subfield A is employed as the LSB subfield, then the subfield B is allocated to the succeeding subfield, while when the subfield B is used as the LSB subfield, then the subfield A is employed as the succeeding subfield. In this way, it is possible to decrease the number of the priming pulses. Similarly, the subfields of different types may preferably be employed for the subfield having the second shortest sustained discharge period and the succeeding subfield, respectively.

Embodiment 8

Figure 15:
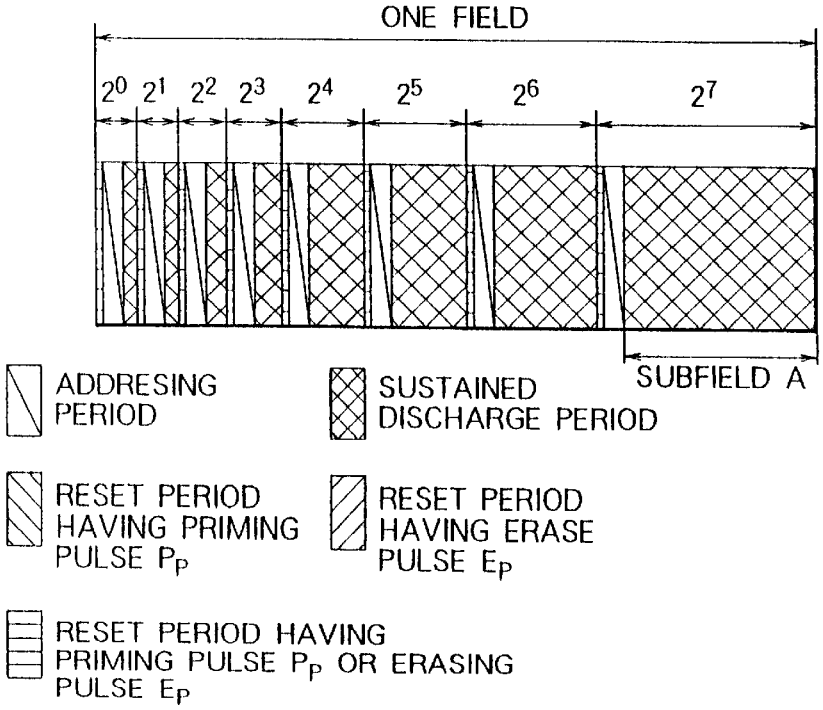
FIG. 15 is a diagram showing a structure of subfields which are generated within one field by employing a plasma display panel driving method according to an eighth embodiment of the present invention.

A driving method for the plane discharge type plasma display panel according to an eighth embodiment of the present invention will be described by reference to FIG. 15 which shows schematically another example of array of subfields within one field for the 256-gradation display. In the following descriptions it is assumed that the resetting operation is performed simultaneously for the whole panel (as in the case of the first and second embodiments). However, the teaching of the invention incarnated in the instant embodiment may equally be applied to such reset method which is performed by scanning the lines with the priming pulse Pp (as described hereinbefore in conjunction with the third embodiment). Referring to FIG. 15, the subfield number "$2^n$" (where n=0, . . . , 7) represents the subfield having the light emission period of a corresponding ratio. In the driving method according to the instant embodiment of the invention, the MSB subfield is selected as the subfield A in which the whole panel write is performed. According to the instant embodiment of the invention, the MSB subfield is employed as the subfield A in which the write operation is performed for the whole panel The other subfields may be constituted by the subfield A and/or the subfield B, as described hereinbefore.

The MSB subfield has the longest sustained discharge period in one field. More specifically, the MSB subfield is highest in luminance and exerts remarkable influence to the picture or image as displayed when the addressing operation is failed. Accordingly, the MSB subfield is selected as the subfield A to ensure high reliability for the addressing.

As will now be appreciated from the foregoing description, by selecting the MSB subfield having the longest sustained discharge period as the subfield A and by decreasing the number of the times the priming operation is performed in the other subfields, it is possible to enhance contrast of the image as displayed while allowing the number of the priming operation to be decreased without exerting any adverse influence to the addressing Embodiment 9

Figure 16:
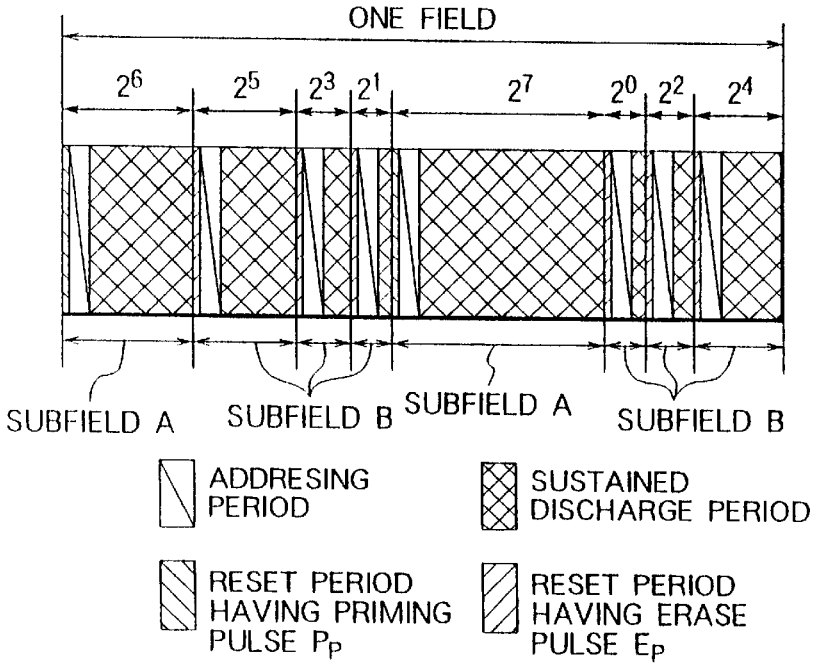
FIG. 16 is a diagram showing a structure of subfields which are generated within one field by employing a plasma display panel driving method according to a ninth embodiment of the present invention.
Figure 17:
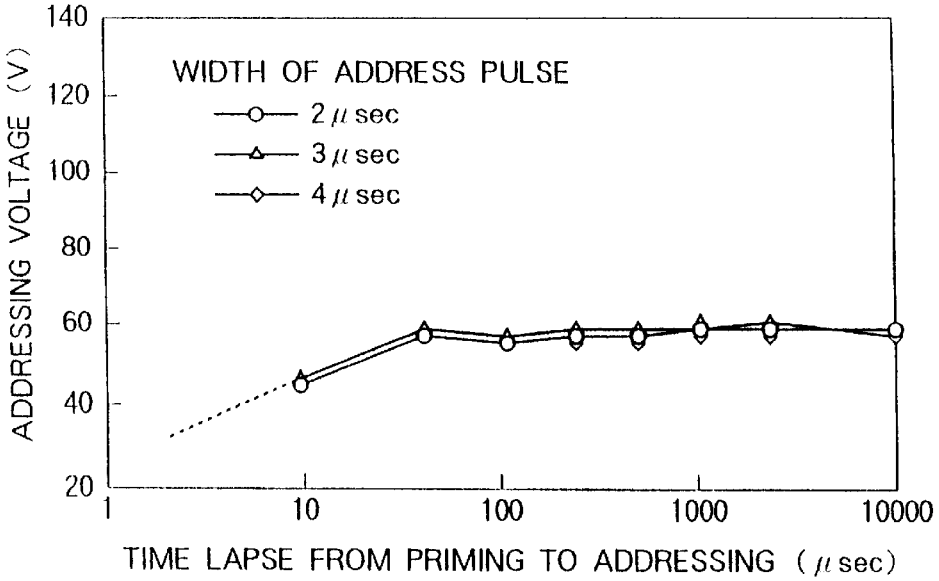
FIG. 17 is a view for graphically illustrating relation between a time lapse from a priming operation to an addressing operation and an addressing voltage.
Figure 18:
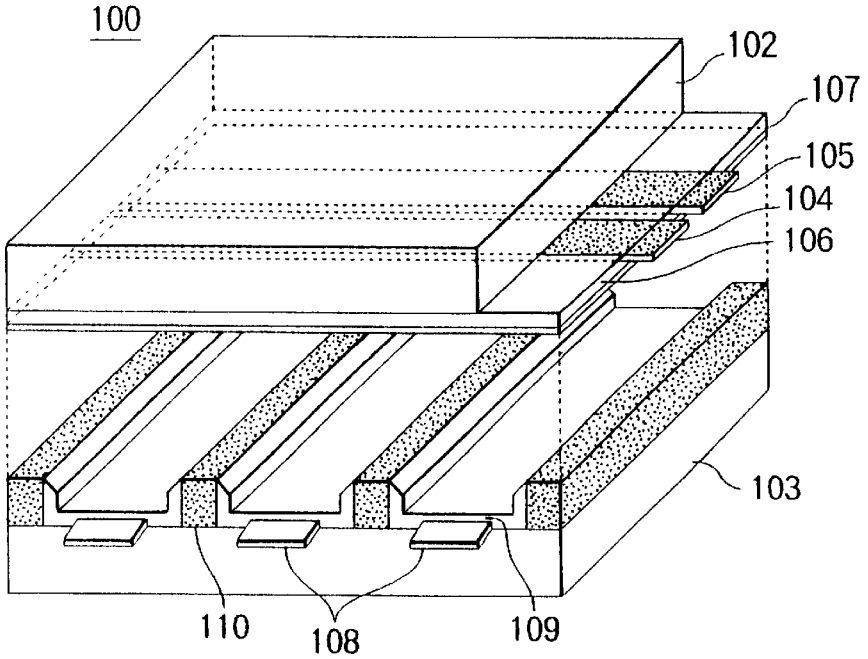
FIG. 18 PRIOR ART
FIG. 18 shows partially in a perspective view a conventional plane discharge type plasma display panel known heretofore.
Figure 19:
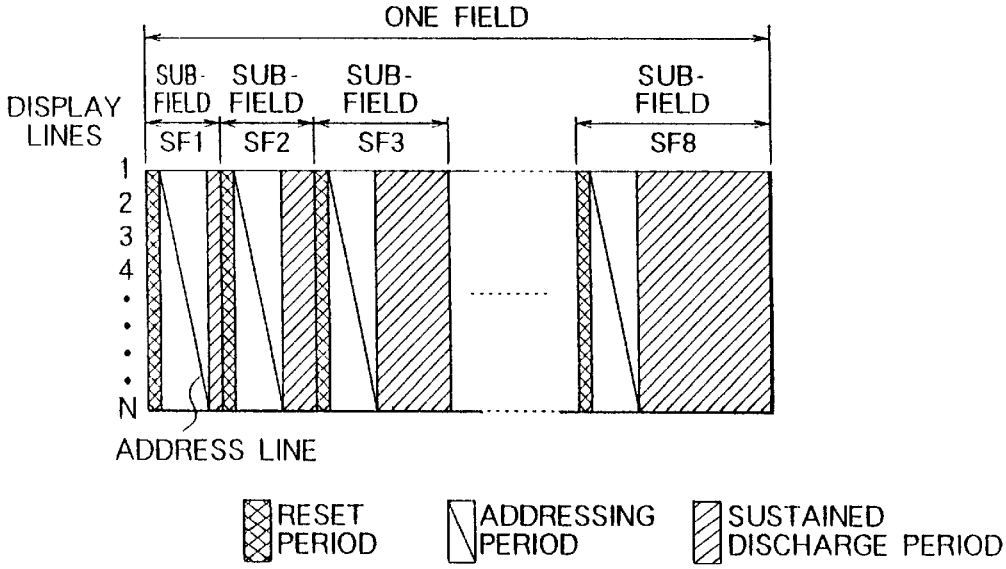
FIG. 19 PRIOR ART
FIG. 19 is a view showing a structure within one field for illustrating a method of displaying picture data with gradation by using the conventional plasma display panel.
Figure 20:
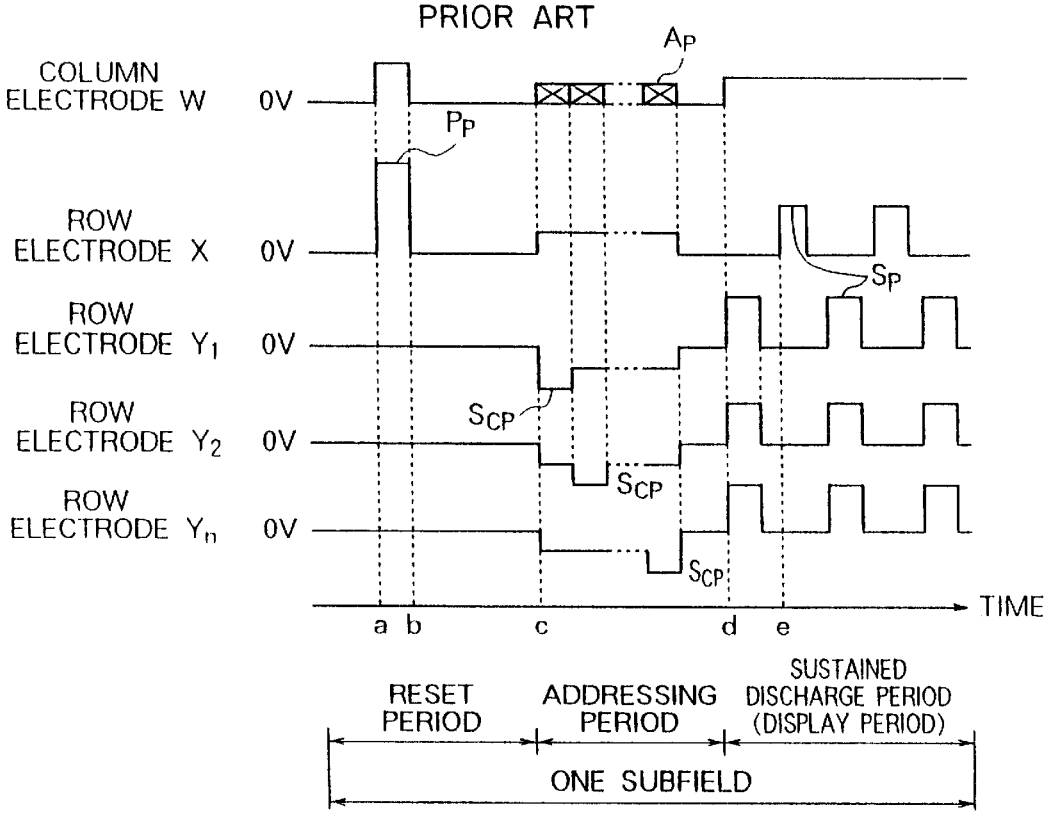
FIG. 20 PRIOR ART
FIG. 20 is a waveform diagram showing voltage waveforms for illustrating a plasma display panel driving method according to a first related art.
Figure 21:
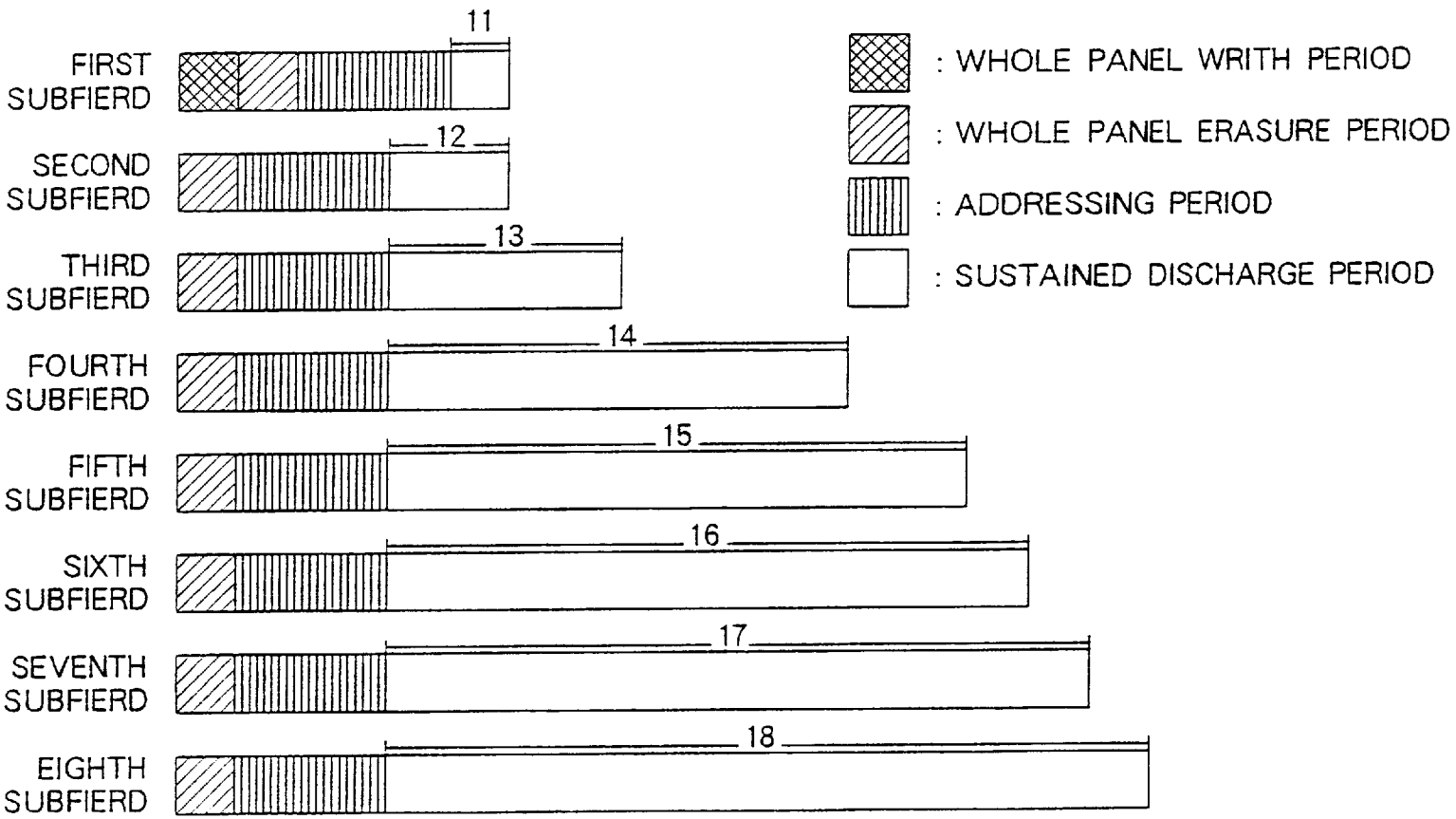
FIG. 21 PRIOR ART
FIG. 21 is a diagram showing a structure of subfields which are generated within one field by employing a plasma display panel driving method according to a second related art.
Figure 22:
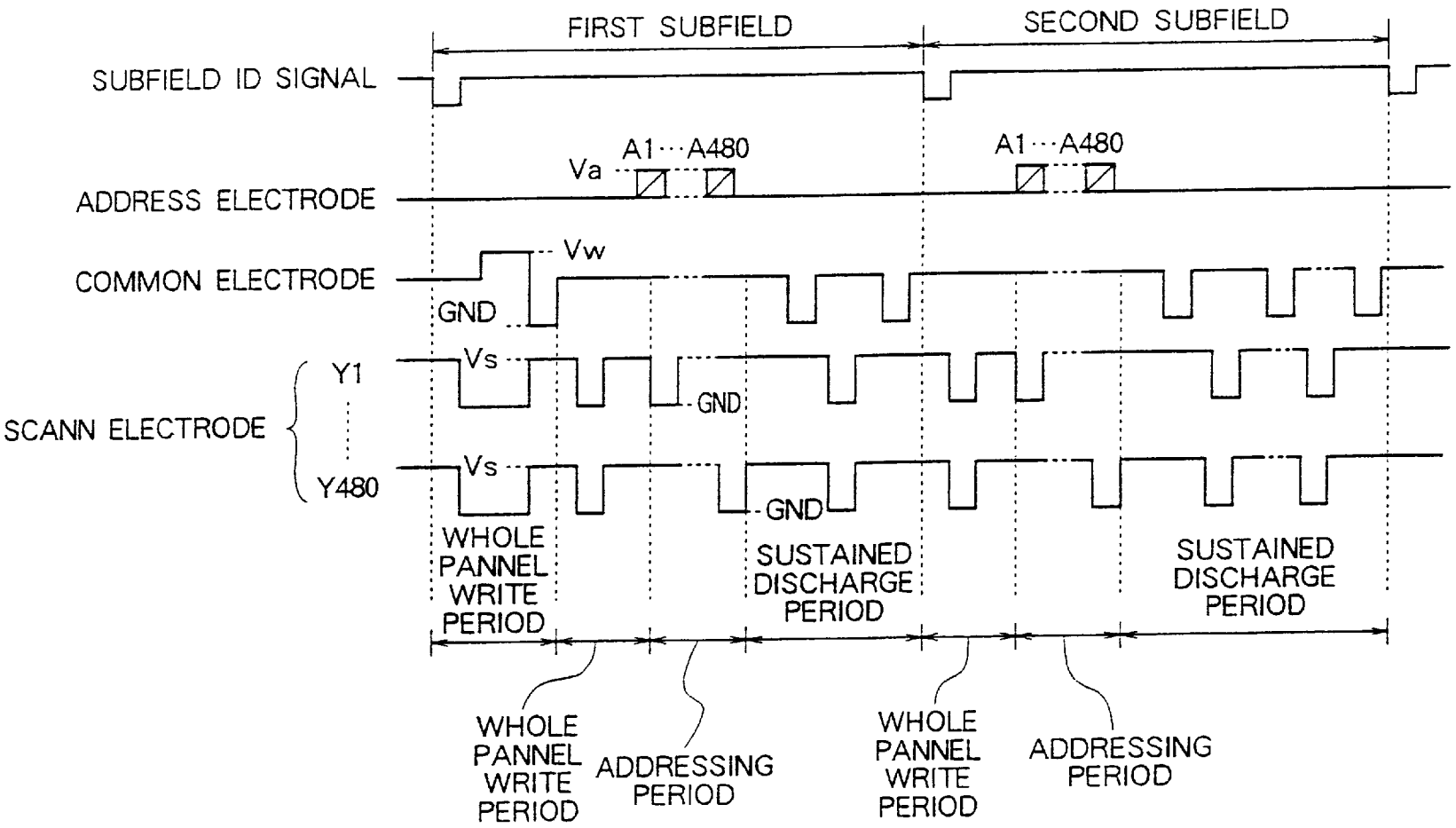
FIG. 22 PRIOR ART
FIG. 22 is a waveform diagram showing voltage waveforms for illustrating the plasma display panel driving method according to the second related art.

A ninth embodiment of the present invention will be described by reference to FIG. 16 which is a view showing a driving method for a plane discharge type plasma display panel according to the ninth embodiment and shows another example of structure of subfields within one field for the 256-gradation display. Further, FIG. 17 is a view for graphically illustrating variation in the addressing voltage as brought about by varying the time intervening between the priming and addressing operations. The priming operation is preferably to be performed at a high frequency. However, the effect or action of the priming remains effectively over a period of 10 msec at the shortest. Accordingly, within this period, the addressing operation can be performed satisfactorily without resorting to the priming. In more concrete, by performing the priming operation twice within one field (i.e., during a period of 16.7 msec), the addressing operation can be realized without encountering any difficulty. The subfield array shown in FIG. 16 is designed by taking into consideration the observed fact mentioned above.

When no light emission takes place in the MSB subfield which has the longest duration therefor due to failure of addressing, the corresponding defect of the image is visually perceptible to the viewer, because luminance will then decrease remarkably. Accordingly, it is proposed according to the invention implemented in the instant embodiment that the MSB subfield and the subfield having the second longest light emission duration are selected as the subfields A, respectively, with the remaining subfields being employed as the subfields B, wherein the subfields are arrayed such that the time intervening between the priming operation in the MSB subfield and the priming operation in the $2^6$-th subfield relative to the time intervening between the priming operation in the $2^6$-th subfield and the priming operation in the MSB subfield assumes a minimum difference. By arraying the subfields in this way, the interval for the priming operation can be made substantially constant. Besides, false or pseudo-contour can effectively be suppressed in the gradation display based on the subfields.

At this juncture, it should however be mentioned that the sequence in which the subfields are arrayed may vary in dependence on the pulse width of the addressing pulse as well as the number of image scanning lines. Accordingly, the invention is never limited exactly to the array shown in FIG. 16. It is sufficient to array the subfields such that the difference in the time or temporal duration between the MSB subfield and the subfield having the second longest sustained discharge period becomes minimum.

Many features and advantages of the present invention are apparent from the foregoing detailed description and thus it is intended to cover by the claims all such features and advantages of the system which fall within the true spirit and scope of the invention. Further, since numerous modifications and combinations will readily occur to those skilled in the art, it is not intended to limit the invention to the exact construction and operation illustrated and described.

By way of example, although the invention has been described in conjunction with the display with 256-gradation levels in the fifth to ninth embodiments, the invention is never limited to such display. Furthermore, the embodiments of the invention which are believed to be preferred at present have been described in conjunction with the AC type plasma display device of the typical structure shown in FIG. 1, the invention is never restricted to the application to such display panel. By way of example, the first and second electrodes need not extend in parallel to each other. Further, a dielectric layer covering the third electrode may be provided. Besides, another dielectric layer may be interposed between the third electrode and the phosphor layer. Of course, it goes without saying that the phosphor layer may be spared in the case of a black-and-white display device.

Accordingly, all suitable modifications and equivalents may be resorted to, falling within the spirit and scope of the invention.

What is claimed is:

1. A method of driving a plasma display panel device which is comprised of a plurality of first electrodes and a plurality of second electrodes covered with a dielectric layer, and a plurality of third electrodes disposed so as to extend orthogonally to at least one of said first and second electrodes to thereby define individual cells, respectively, wherein a plurality of fields for image display each comprise at least two types of subfields including first and second subfields;

said first subfield comprising:

a first reset period in which a priming pulse having a voltage value and a pulse width for causing discharge to occur in all of said cells defined between said first electrodes and said second electrodes is applied and after the discharge of all of said cells, a voltage applied between said first and second electrodes is set to zero for erasing wall charge stored in said dielectric layer;

an addressing period in which a write operation is performed by bringing about electric discharge between said first or second electrodes and said third electrodes for thereby allowing the wall charge to be stored in said dielectric layer; and a sustained discharge period in which an AC voltage is applied between said first and second electrodes for thereby realizing a sustained discharge by making use of said wall charge stored in said dielectric layer; and said second subfield comprising:

a second reset period in which an erasing pulse having a voltage value and a pulse width for causing only the cells discharged in the preceding subfield to be discharged is applied for allowing only the cells discharged in the preceding subfield to be discharged and thereafter the wall charge stored in said dielectric layer is erased by setting to zero the voltage applied between said first and second electrodes;

a second addressing period in which a write operation is performed by causing discharge to take place between said first or second electrodes and said third electrodes to thereby store the wall charge in said dielectric layer; and a second sustained discharge period in which an AC voltage is applied between said first and second electrodes for realizing a sustained discharge by making use of the wall charge stored in said dielectric layer.

2. A driving method for a plasma display panel device according to claim 1, wherein said priming pulse applied in said first subfield and said erasing pulse applied in said second subfield are applied, simultaneously to all of said cells of said plasma display panel device.

3. A driving method for a plasma display panel device according to claim 1, wherein said priming pulse applied in said first subfield is applied through line sequential scanning in a rowwise direction of said plasma display panel device.

4. A method of driving a plasma display panel device which is comprised of a plurality of first electrodes and a plurality of second electrodes covered with a dielectric layer, and a plurality of third electrodes disposed so as to extend orthogonally to at least one of said first and second electrodes to thereby define individual cells, respectively, wherein a plurality of fields for image display each include a first subfield which comprises at least:

a first reset period in which a priming pulse having a voltage value and a pulse width for causing discharge to occur in all of said cells defined between said first electrodes and said second electrodes is applied and after the discharge of all of said cells, a wall charge stored in said dielectric is erased;

an addressing period in which a write operation is performed by causing electric discharge to occur between said first or second electrodes and said third electrodes for thereby storing a wall charge in said dielectric layer; and a sustained discharge period in which an AC voltage is applied between said first and second electrodes for thereby realizing a sustained discharge by making use of said wall charge stored in said dielectric layer, wherein said first subfield is executed for every other line or every several-th line of said plasma display panel device but not for alternative other or alternative several-th lines of said plasma display panel device.

5. A driving method for a plasma display panel device according to claim 4, wherein during said first reset period of said first subfield, a priming pulse having a voltage value and a pulse width for causing all of said cells to discharge is applied between said first and second electrodes and after the discharge of all of said cells, the voltage applied between said first and second electrodes is set to zero to thereby erase the wall charge stored in said dielectric layer, wherein the plurality of fields for image display each further include a second subfield which comprises at least:

a second reset period in which an erasing pulse having a voltage value and a pulse width for causing only the cells discharged in the preceding subfield to be discharged is applied for allowing only the cells discharged in the preceding subfield to be discharged and thereafter the wall charge stored in said dielectric layer is erased by setting to zero the voltage applied between said first and second electrodes;

a second addressing period in which a write operation is performed by causing discharge to take place between said first or second electrode and said third electrodes to thereby store the wall charge in said dielectric layer; and a second sustained discharge period in which an AC voltage is applied between said first and second electrodes for realizing a sustained discharge by making use of the wall charge stored in said dielectric layer, wherein said second subfield is executed for the cells for which said first subfield has not been executed.

6. A driving method for a plasma display panel device according to claim 4, said first or second electrodes of said plasma display panel device being connected in common on an odd-numbered line basis or on an even-numbered line basis, wherein said first subfield having said priming pulse is generated at least once for at least one of said odd-numbered lines and said even-numbered lines.

7. A driving method for a plasma display panel device according to claim 4, said first or second electrodes of said plasma display panel device being connected in common on an odd-numbered line basis or on an even-numbered line basis, wherein said first subfield having said priming pulse is executed for said odd-numbered lines and said even-numbered lines.

8. A driving method for a plasma display panel device according to claim 2, wherein said priming pulse is a voltage pulse having a pulse width longer than 2 $\mu$sec inclusive, while said erasing pulse has a pulse width not longer than 1.5 $\mu$sec, and wherein the voltage value of said erasing pulse is not higher than that of said priming pulse.

9. A driving method for a plasma display panel device according to claim 6, wherein said priming pulse is a voltage pulse having a pulse width longer than 2 $\mu$sec inclusive, while said erasing pulse has a pulse width not longer than 1.5 $\mu$sec, and wherein the voltage value of said erasing pulse is not higher than that of said priming pulse.

10. A driving method for a plasma display panel device according to claim 7, wherein said priming pulse is a voltage pulse having a pulse width longer than 2 $\mu$sec inclusive, while said erasing pulse has a pulse width not longer than 1.5 $\mu$sec, and wherein the voltage value of said erasing pulse is not higher than that of said priming pulse.

11. A driving method for a plasma display panel device according to claim 8, wherein the voltage value of said erasing pulse is not lower than a voltage value of a sustaining pulse for realizing the sustained discharge during the sustained discharge period.

12. A driving method for a plasma display panel device according to claim 9, wherein the voltage value of said erasing pulse is not lower than a voltage value of a sustaining pulse for realizing the sustained discharge during the sustained discharge period.

13. A driving method for a plasma display panel device according to claim 10, wherein the voltage value of said erasing pulse is not lower than a voltage value of a sustaining pulse for realizing the sustained discharge during the sustained discharge period.

14. A driving method for a plasma display panel device according to claim 11, wherein the voltage value of said erasing pulse is not lower than a voltage value at which self-extinction discharge takes place.

15. A driving method for a plasma display panel device according to claim 12, wherein the voltage value of said erasing pulse is not lower than a voltage value at which self-extinction discharge takes place.

16. A driving method for a plasma display panel device according to claim 13, wherein the voltage value of said erasing pulse is not lower than a voltage value at which self-extinction discharge takes place.

17. A driving method for a plasma display panel device according to claim 8, wherein said erasing pulse and said priming pulse are generated by the same pulse generating means having a switching element and have a same voltage value.

18. A driving method for a plasma display panel device according to claim 9, wherein said erasing pulse and said priming pulse are generated by the same pulse generating means having a switching element and have a same voltage value.

19. A driving method for a plasma display panel device according to claim 10, wherein said erasing pulse and said priming pulse are generated by the same pulse generating means having a switching element and have a same voltage value.

20. A driving method for a plasma display panel device according to claim 3, wherein said priming pulse applied in said first subfield is applied to said second electrodes through line sequential scanning.

* * * * *